US008125302B2

(12) United States Patent
Kawai et al.

(10) Patent No.: US 8,125,302 B2
(45) Date of Patent: Feb. 28, 2012

(54) SIGNAL SELECTING DEVICE

(75) Inventors: Kunihiro Kawai, Yokohama (JP); Kei Satoh, Yokosuka (JP); Hiroshi Okazaki, Zushi (JP); Shoichi Narahashi, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 644 days.

(21) Appl. No.: 12/207,037

(22) Filed: Sep. 9, 2008

(65) Prior Publication Data

US 2009/0066443 A1 Mar. 12, 2009

(30) Foreign Application Priority Data

Sep. 10, 2007 (JP) ..... 2007-234099

(51) Int. Cl.
*H01P 1/203* (2006.01)
*H01P 7/08* (2006.01)

(52) U.S. Cl. ..... 333/205; 333/235; 333/33; 333/35

(58) Field of Classification Search ..... 333/17.1, 333/17.3, 32, 33, 165–168, 175, 176, 185, 333/202–205, 219, 235
See application file for complete search history.

(56) References Cited

U.S. PATENT DOCUMENTS 5,162,759 A 11/1992 Yajima
5,659,274 A * 8/1997 Takahashi et al. ..... 333/204
6,326,865 B1 * 12/2001 Kundu et al. ..... 333/202
6,549,097 B2 * 4/2003 Guillon et al. ..... 333/174
6,778,023 B2 * 8/2004 Christensen ..... 331/16
7,570,973 B1 8/2009 Bienek et al.
2003/0025563 A1 2/2003 Christensen
2005/0190018 A1 9/2005 Kawai et al.
2006/0087388 A1 4/2006 Kawai et al.

FOREIGN PATENT DOCUMENTS

EP 1 898 486 A1 3/2008
GB 2 332 785 A 6/1999
(Continued)

OTHER PUBLICATIONS

Ming-Fong Lei, et al., "An Analysis of Miniaturized Dual-Mode Bandpass Filter Structure Using Shunt-Capacitance Perturbation", IEEE Transactions on Microwave Theory and Techniques, XP011128131, vol. 53, No. 3, Mar. 1, 2005, pp. 861-867.

(Continued)

*Primary Examiner* — Benny Lee
*Assistant Examiner* — Gerald Stevens
(74) *Attorney, Agent, or Firm* — Oblon, Spivak, McClelland, Maier & Neustadt, L.L.P.

(57) ABSTRACT

A signal selecting device according to the present invention has two input/output ports, a plurality of resonating parts, a plurality of impedance transforming parts, and a controlling part. The resonating parts have a ring conductor having a length equal to one wavelength at a resonant frequency or an integral multiple thereof and a plurality of switches each of which is connected to a different part of the ring conductor at one end and to a ground conductor at the other end. The controlling part controls the state of the switches. The resonating parts are disposed in series between the two input/output ports. The impedance transforming parts are disposed between the input/output ports in such a manner that the impedance transforming parts at the both ends are disposed between the input/output port and the resonating part and the remaining impedance transforming parts are disposed between the resonating parts.

11 Claims, 21 Drawing Sheets

FOREIGN PATENT DOCUMENTS

| | | |
|---|---|---|
| JP | 2001-230602 | 8/2001 |
| JP | 2002-526969 | 8/2002 |
| JP | 2004-7352 | 1/2004 |
| JP | 2005-217852 | 8/2005 |

OTHER PUBLICATIONS

Kunihiro Kawai, et al., "Ring Resonators for Bandwidth and Center Frequency Tunable Filter", Proceedings of the 37th European Microwave Conference, XP031191793, Oct. 1, 2007, pp. 298-301.
Dimitrios Peroulis, et al., "Tunable Lumped Components with Applications to Reconfigurable MEMS Filters", 2001, IEEE MTT-S Digest, TU4C-6, 2001, pp. 341-344.
Hong-Teuk Kim, et al., "Low-Loss and Compact V-Band MEMS-Based Analog Tunable Bandpass Filters", IEEE Microwave and Wireless Components Letter, vol. 12, No. 11, Nov. 2002, pp. 432-434.
E. Fourn, et al., "Bandwidth and Central Frequency Control on Tunable Bandpass Filter by Using MEMS Cantilevers", 2003 IEEE MTT-S Digest, IFTU-21, 2003, pp. 523-526.
Arnaud Pothier, et al., "Low-Loss 2-Bit Tunable Bandpass Filters Using MEMS DC Contact Switches", IEEE Transactions on Microwave Theory and Techniques, vol. 53, No. 1, Jan. 2005, pp. 354-360.
Bruce E. Carey-Smith, et al., "Wide Tuning-Range Planar Filters Using Lumped-Distributed Coupled Resonators", IEEE Transactions on Microwave Theory and Techniques, vol. 53, No. 2, Feb. 2005, pp. 777-785.
Kamran Entesari, et al., "A Differential 4-bit 6.5-10-GHz RF MEMS Tunable Filter", IEEE Transactions on Microwave Theory and Techniques, vol. 53, No. 3, Mar. 2005, pp. 1103-1110.
Kamran Entesari, et al., "A 12-18-GHz Three-Pole RF MEMS Tunable Filter", IEEE Transactions on Microwave Theory and Techniques, vol. 53, No. 8, Aug. 2005, pp. 2566-2571.
Lung-Hwa Hsieh, et al., "Slow-Wave Bandpass Filters Using Ring or Stepped-Impedance Hairpin Resonators", IEEE Transactions on Microwave Theory and Techniques, vol. 50, No. 7, Jul. 2002, pp. 1795-1800.
Kunihiro Kawai, et al., "Tunable Resonator Employing Comb-Shaped Transmission Line and Switches", Oct. 2005, 4 Pages.
Arun Chandra Kundu, et al., "Attenuation Pole Frequency Control of a Dual-Mode Circular Microstrip Ring Resonator BPF", 29th European Microwave Conference—Munich 1999, Oct. 1999, pp. 329-332.
Kunihiro Kawai, et al., "Tunable Band-pass Filter Employing Comb-shaped Transmission Line Resonator," C-2-37, 2005, 4 pages (with English Translation).
Kunihiro Kawai, et al., "Center-frequency and Bandwidth Tunable Band-pass Filter Employing Comb-shaped Transmission Line Resonator", C-2-35, 2006, 4 pages (with English Translation).
Kunihiro Kawai, et al., "Center Frequency and Bandwidth Tunable Filter Employing Tunable Comb-Shaped Transmission Line Resonators and J-inverters", Proceedings of the 3th European Microwave Conference, Sep. 2006, pp. 649-652.
Kunihiro Kawai, et al., "Comb-shaped Transmission Line Tunable Resonator Employing MEMS RF Switches", C-2-77, 2006, 4 pages (with English Translation).
Lei Zhu, et al., "A Joint Field/Circuit Design Model of Microstrip Ring Dual-Mode Filter: Theory and Experiments", 1997 Asia Pacific Microwave Conference, 4P18-7, pp. 865-868.
S. H. Al-Charchafchi, et al., "Varactor tuned microstrip ring resonators", IEE Proceedings, vol. 136, Pt. H, No. 2, Apr. 1989, pp. 165-168.
T. Scott Martin, et al., "Electronically Tunable and Switchable Filters Using Microstrip Ring Resonator Circuits", 1988 IEEE MTT-S Digest, OF-2-22, 1988, pp. 803-806.
P. Gardner, et al., "Microwave voltage tuned microstrip ring resonator oscillator", Electronic Letters, vol. 30, No. 21, Oct. 13, 1994, pp. 1770-1771.
Michiaki Matsuo, et al., "Dual-Mode Stepped-Impedance Ring Resonator for Bandpass Filter Applications", IEEE Transactions on Microwave Theory and Techniques, vol. 49, No. 7, Jul. 2001, pp. 1235-1240.
Hitoshi Ishida, et al., "A design of tunable UWB filters", 2004 IEEE, FA4-5, May 2004, pp. 424-428.
Masaaki Koiwa, et al., "Multiband Mobile Terminals", NTT DoCoMo Technical Journal, vol. 8, No. 2, Jul. 2006, 15 pages (with English Translation).
Japanese Office Action issued Aug. 16, 2011, in Patent Application No. 2007-234099 (with English-language translation).
Kunihiro Kawai, et al., "Bandwidth Tunable Filter Employing Ring Resonator with Switches", 2007 Proceedings 1 of the Electronics Society Conference of the Institute of Electronics, Information and Communication Engineers, Aug. 29, 2007, p. 86, C-2-64.

* cited by examiner

SIGNAL SELECTING DEVICE

BACKGROUND OF THE INVENTION

The present invention relates to a signal selecting device used in transmission, reception or transmission/reception of information. In the field of radio communication using radio waves, necessary signals and unnecessary signal are separated by extracting signals at a particular frequency from a large number of signals. Filters that perform this function comprise a resonator and an impedance transforming circuit and are incorporated in many radio devices. Such filters cannot change design parameters, such as the center frequency and the bandwidth. Therefore, a radio communication device using a plurality of combinations of center frequencies and bandwidths has to have a number of filters equal to the number of combinations of center frequencies and bandwidths and select a filter for use by means of a switch or the like. For example, a non-patent literature 1 (DoCoMo Technical Journal Vol. 14, No. 2, pp. 31-37) discloses a related art in which a filter for use is selected from among a plurality of filters by means of a switch.

Related arts, such as that disclosed in the non-patent literature 1, have a problem that, as the number of combinations of center frequencies and bandwidths increases, the circuit area and the number of components also increase. An object of the present invention is to provide a filter capable of appropriately changing a center frequency and a bandwidth by controlling characteristics of a resonator and an impedance transforming circuit and to reduce the number of filters used even when a plurality of combinations of center frequencies and bandwidths is used.

SUMMARY OF THE INVENTION

A signal selecting device according to the present invention has two input/output ports, a plurality of resonating parts, a plurality of impedance transforming parts, and a controlling part. The resonating parts have a ring conductor having a length equal to one wavelength at a resonant frequency or an integral multiple thereof and a plurality of switches each of which is connected to a different part of the ring conductor at one end and to a ground conductor at the other end. The controlling part controls the state of the switches. The resonating parts are disposed in series between the two input/output ports. The impedance transforming parts are disposed between the input/output ports in such a manner that the impedance transforming parts at the both ends are disposed between the input/output port and the resonating part and the remaining impedance transforming parts are disposed between the resonating parts. That is, the number of the impedance transforming parts is greater than the number of resonating parts by one. The impedance transforming parts adjust the impedance between the outside and the resonating parts or between the resonating parts. The term "ring conductor" means a conductor (a transmission line) having the opposite ends thereof connected to each other and is not limited to a particular shape. That is, the shape of the ring conductor is not limited to a circular shape, but the ring conductor can have any other shape, such as a polygonal shape.

The impedance transforming parts may be capable of changing the characteristics. In that case, the controlling part controls the characteristics of the impedance transforming parts. In particular, in a case where the signal selecting device has an odd number of resonating parts, all the impedance transforming parts can be configured to have the same characteristics at the operational frequency of the signal selecting device. Alternatively, in a case where the signal selecting device has an even number of resonating parts (it means that the number of the impedance transforming parts is an odd number), the impedance transforming part disposed at the center alone can be controlled to have characteristics different from those of the remaining impedance transforming parts.

Three or more variable reactance means can be connected to the ring conductor at regular intervals. In that case, the controlling part controls the characteristics of the variable reactance means.

One or more branch parts can be disposed between the impedance transforming parts and the resonating parts, and a switch part can be disposed between one of the input/output port and the impedance transforming parts. In that case, switching can be performed so that one of the branch parts is selected and is connected to the switch part.

EFFECT OF THE INVENTION

According to the present invention, the resonating parts having the ring conductor and the switches can arbitrarily change the susceptance slope parameter highly independently of the resonant frequency. Therefore, the signal selecting device can be easily designed to have desired characteristics. In addition, the bandwidth and the in-band and out-band characteristics can also be changed by changing the susceptance slope parameter of the resonating parts.

Furthermore, in a case where the resonating parts have variable reactance means connected to the ring conductor at appropriate intervals, the signal selecting device can change the center frequency highly independently of the bandwidth and the in-band and out-band characteristics. In addition, in a case where the characteristics of the impedance transforming parts can be changed, the signal selecting device can more appropriately adjust the bandwidth and the in-band and out-band characteristics.

Furthermore, in a case where the signal selecting device has the branch parts and the switch part, the number of resonators can be changed. That is, the bandwidth and the in-band and out-band characteristics can be more flexibly adjusted.

DETAILED DESCRIPTION OF THE PREFERRED EMBODIMENTS

Embodiment 1

Figure 1:
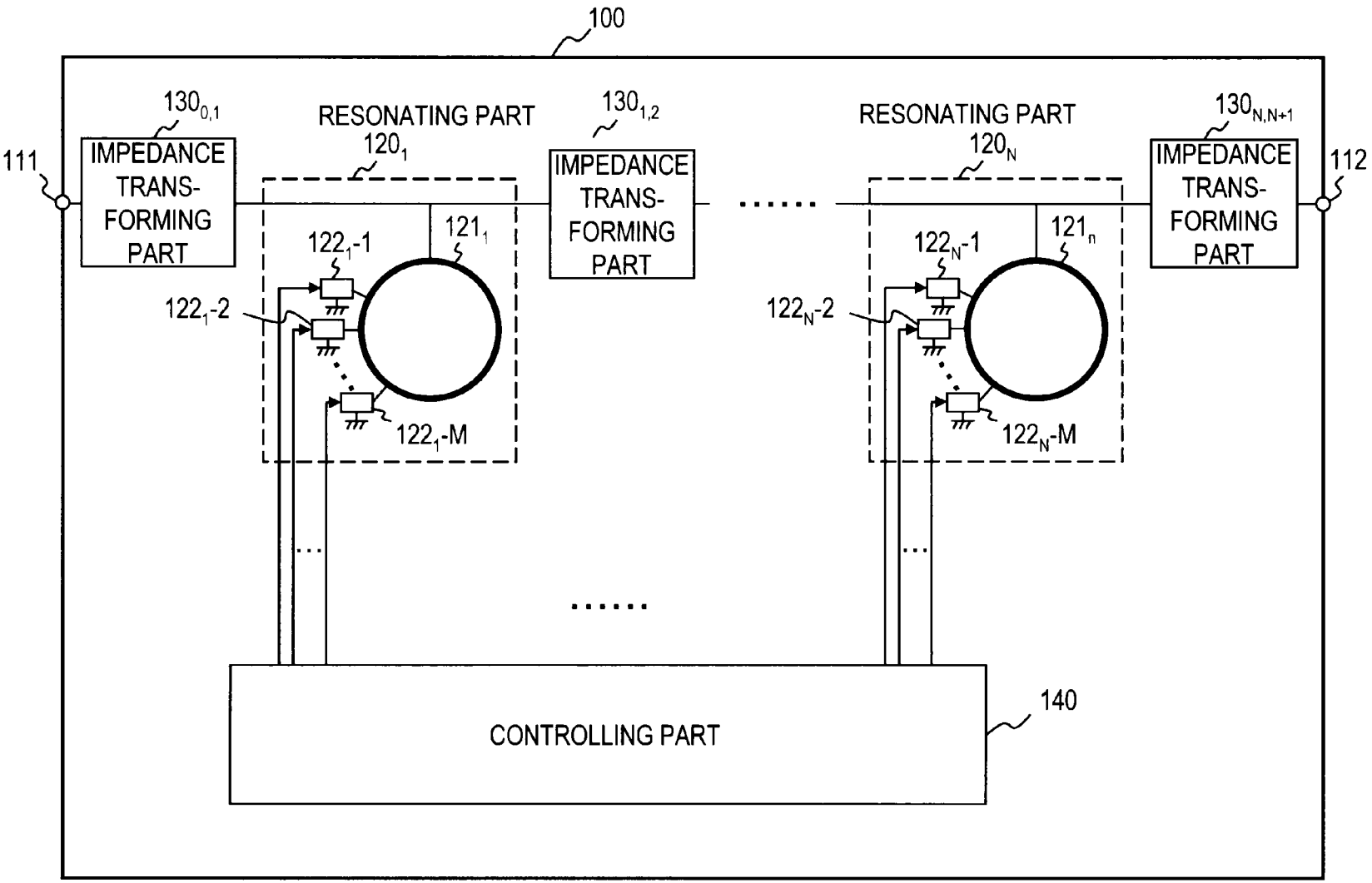
FIG. 1 is a diagram showing an exemplary functional configuration of a signal selecting device according to an embodiment 1.

FIG. 1 is a diagram showing an exemplary functional configuration of a signal selecting device according to an embodiment 1. A signal selecting device 100 has two input/output ports 111 and 112, N resonating parts $\mathbf{120}_1$ to $\mathbf{120}_N$, N+1 impedance transforming parts $\mathbf{130}_{0,1}$ to $\mathbf{130}_{N,N+1}$, and a controlling part 140. The resonating part $\mathbf{120}_n$ (n represents any integer in a possible range and is an integer from 1 to N in this case) has a ring conductor $\mathbf{121}_n$ having a length equal to one wavelength at a resonant frequency or an integral multiple thereof, and M switches $\mathbf{122}_n$-1 to $\mathbf{122}_n$-M each of which is connected to a different part of the ring conductor $\mathbf{121}_n$ at one end thereof and to a ground conductor at the other end thereof. The controlling part 140 controls the state of the N*M switches $\mathbf{122}_1$-1 to $\mathbf{122}_N$-M. ("N*M" shows multiplying N by M.) The resonating parts $\mathbf{120}_1$ to $\mathbf{120}_N$ are disposed in series between the two input/output ports. The impedance transforming parts $\mathbf{130}_{0,1}$ to $\mathbf{130}_{N,N+1}$ are disposed between the input/output ports in such a manner that the impedance transforming parts $\mathbf{130}_{0,1}$ and $\mathbf{130}_{N,N+1}$ at the both ends are disposed between the input/output port and the resonating part and the remaining impedance transforming parts $\mathbf{130}_{1,2}$ to $\mathbf{130}_{N-1,N}$ are disposed between the resonating parts. Specifically, the impedance transforming part $\mathbf{130}_{n,n+1}$ (n represents any integer in a possible range as described above and is an integer from 1 to N−1 in this case) is disposed between the resonating part $\mathbf{120}_n$ and the resonating part $\mathbf{120}_{n+1}$ and adjusts the impedance between the resonating parts $\mathbf{120}_n$ and the resonating part $\mathbf{120}_{n+1}$. The impedance transforming part $\mathbf{130}_{0,1}$ changes the impedance between the outside on the input/output port 111 and the resonating part $\mathbf{120}_1$. The impedance transforming part $\mathbf{130}_{N,N+1}$ changes the impedance between the resonating part $\mathbf{120}_N$ and the outside on the input/output port 112. The ring conductor $\mathbf{121}_n$ means a conductor (a transmission line) having the opposite ends thereof connected to each other and is not limited to a particular shape. That is, while the ring conductor has a circular shape in FIG. 1, the ring conductor can have a polygonal or other shape instead of the circular shape.

Figure 2B:
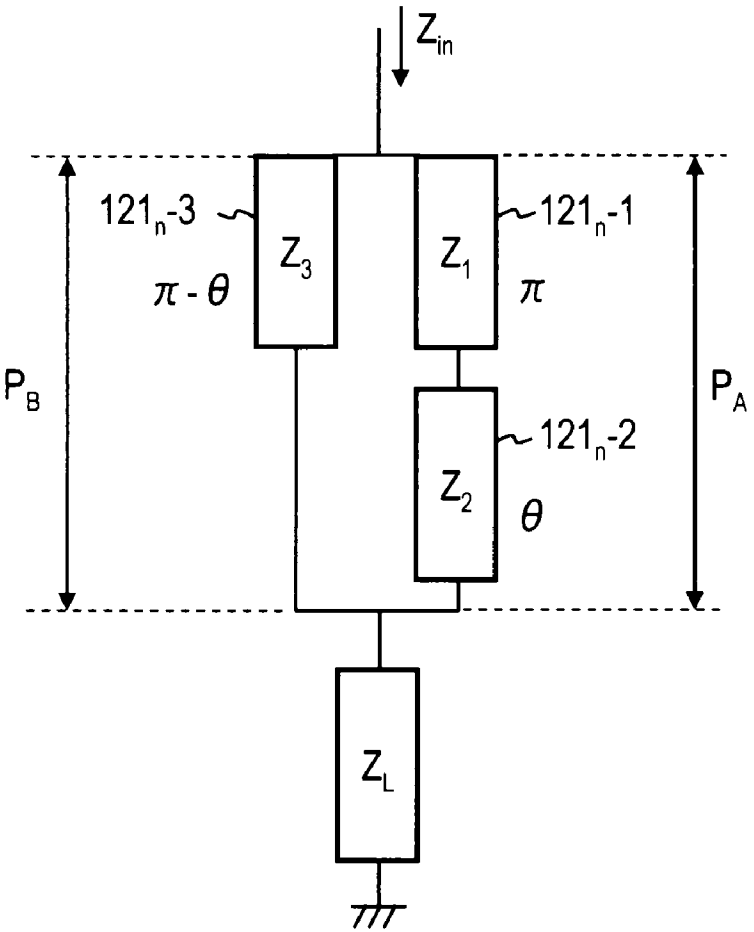
FIG. 2B is a diagram showing an equivalent circuit using a lossless transmission line model.
Figure 2A:
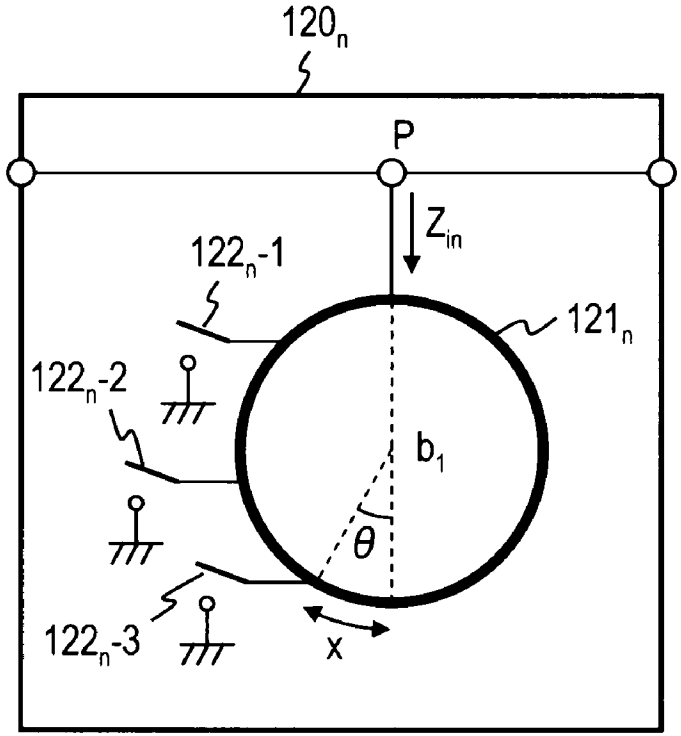
FIG. 2A is a diagram showing a configuration of a resonating part.

FIG. 2A shows a configuration of the resonating part $\mathbf{120}_n$. FIG. 2B shows an equivalent circuit using a lossless transmission line model. $Z_{in}$ denotes the input impedance of the resonating part $\mathbf{120}_n$ from the point P. An operation of the resonating part $\mathbf{120}_n$ will be described by determining the input impedance $Z_{in}$ of the model shown in FIG. 2B in a case where the switch $\mathbf{122}_n$-3 shown in FIG. 2A is in the on state. At a resonant frequency $f_r$, a transmission line $\mathbf{121}_n$-1 has an electrical length of π and a characteristic impedance of $Z_1$, a transmission line $\mathbf{121}_n$-2 has an electrical length of θ and a characteristic impedance of $Z_2$, and a transmission line $\mathbf{121}_n$-3 has an electrical length of (π-θ) and a characteristic impedance of $Z_3$. That is, the total sum of the electrical lengths of the transmission lines $\mathbf{121}_n$-1, $\mathbf{121}_n$-2 and $\mathbf{121}_n$-3 is 2π (360 degrees). A path $P_A$ composed of the transmission line $\mathbf{121}_n$-1 and the transmission line $\mathbf{121}_n$-2 is a path extending clockwise from the point P to the switch $\mathbf{122}_n$-3 in FIG. 2A. A path $P_B$ composed of the transmission line $\mathbf{121}_n$-3 is a path extending counterclockwise from the point P to the switch $\mathbf{122}_n$-3 in FIG. 2A. $Z_L$ denotes the impedance between the switch $\mathbf{122}_n$-3 to the ground.

In this case, the input impedance $Z_{in}$ is expressed by the following formula (1). In this formula, j denotes an imaginary unit.

$$Z_{in} = \frac{y_{22} + Y_L}{y_{11}(y_{22} + Y_L) - y_{12}y_{21}} \tag{1}$$

Figure 3:
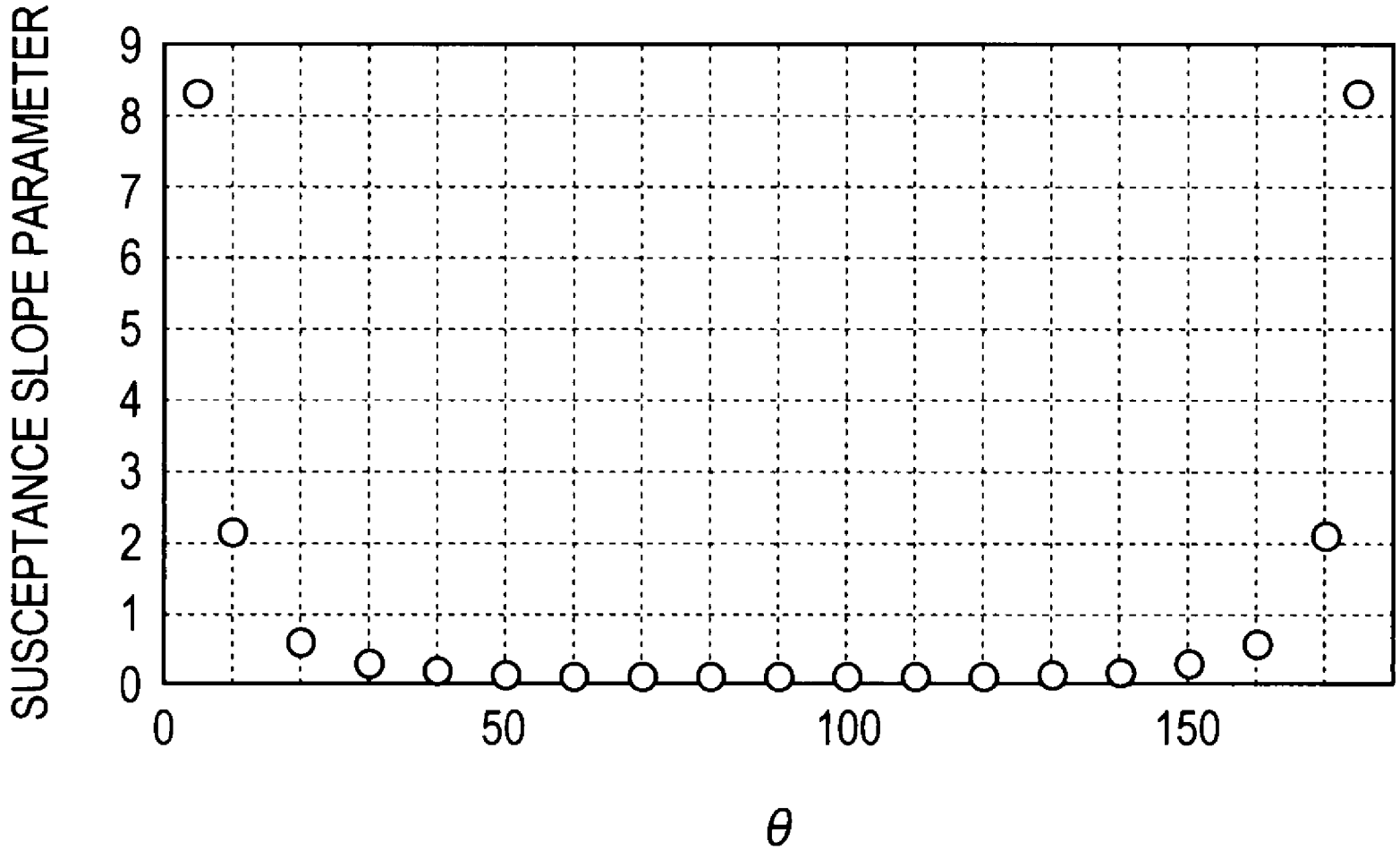
FIG. 3 is a graph showing a relationship between the susceptance slope parameter and θ in a single resonator.

In this formula, $$y_{11} = -jY_2 \cot\theta + jY_3 \cot\theta$$

$$y_{12} = -jY_2 \csc\theta + jY_3 \csc\theta$$

$$y_{21} = -jY_2 \csc\theta + jY_3 \csc\theta$$

$$y_{22} = -jY_2 \cot\theta + jY_3 \cot\theta$$

$$Y_2 = 1/Z_2, Y_3 = 1/Z_3, Y_L = 1/Z_L,$$

where L denotes the length of the ring conductor, and θ=x/2πL (rad). As can be seen from the formula (1), when $Y_2=Y_3$, the impedance $Z_{in}$ is infinity except when θ is 0 or an integral multiple of π. When θ is 0 or an integral multiple of π, $Z_{in}=Z_L$. That is, when the line length (physical length)×changes, the resonant frequency is constant except when the line length reduced to an electrical length at the resonant frequency is 0 or an integral multiple of π. Next, FIG. 3 shows a relationship between θ and the susceptance slope parameter in a single resonator in a case where the impedances $Z_1$, $Z_2$ and $Z_3$ are 50Ω. The susceptance slope parameter b is determined by the following formula.

$$b = \frac{\omega_0}{2} \frac{dB}{d\omega}\bigg|_{\omega_0}, \tag{2}$$

where B=Im ($Y_{in}$), and $Y_{in}=1/Z_{in}$.

From this drawing, it can be seen that the susceptance slope parameter b can be changed without changing the resonant frequency by changing the value θ, or in other words, changing the switch to be turned on. In addition, as can be seen from the formula (2), the susceptance slope parameter b indicates the variation of the imaginary part of the admittance with respect to the frequency. As the susceptance slope parameter b becomes greater, the admittance changes more greatly with respect to the difference frequency with respect to the resonant frequency. Therefore, in a band-pass filter using parallel resonance, for example, the bandwidth becomes narrower. As described later, the in-band and out-band characteristics are determined by the susceptance slope parameter b. That is, the bandwidth and the in-band and out-band characteristics can be changed by the resonating part, and the bandwidth can be changed by changing the susceptance slope parameter b while keeping the center frequency constant.

A principle of changing the bandwidth and the in-band and out-band characteristics of the filter has been described above. Actually, in order to change the bandwidth and the in-band and out-band characteristics of the filter, an appropriate switch $\mathbf{122}_n$-m (m represents any integer in a possible range and is an integer from 1 to M in this case) to be turned on has to be selected from among the large number of switches. In the signal selecting device 100 shown in FIG. 1, the controlling part 140 selects the switch $\mathbf{122}_n$-m to be turned on. In order for the controlling part 140 to select the appropriate switch $\mathbf{122}_n$-m, the controlling part 140 has to consider the relationship between the position of the switch $\mathbf{122}_n$-m to be turned on and the susceptance slope parameter b of the resonating part $\mathbf{120}_n$ and the relationship between the susceptance slope parameter b and the characteristics of the signal selecting device 100. The relationship between the position of the switch $\mathbf{122}_n$-m and the susceptance slope parameter b has already been described with reference to FIG. 3. In the following, the relationship between the susceptance slope parameter b and the characteristics of the signal selecting device 100 will be described.

Figure 4:
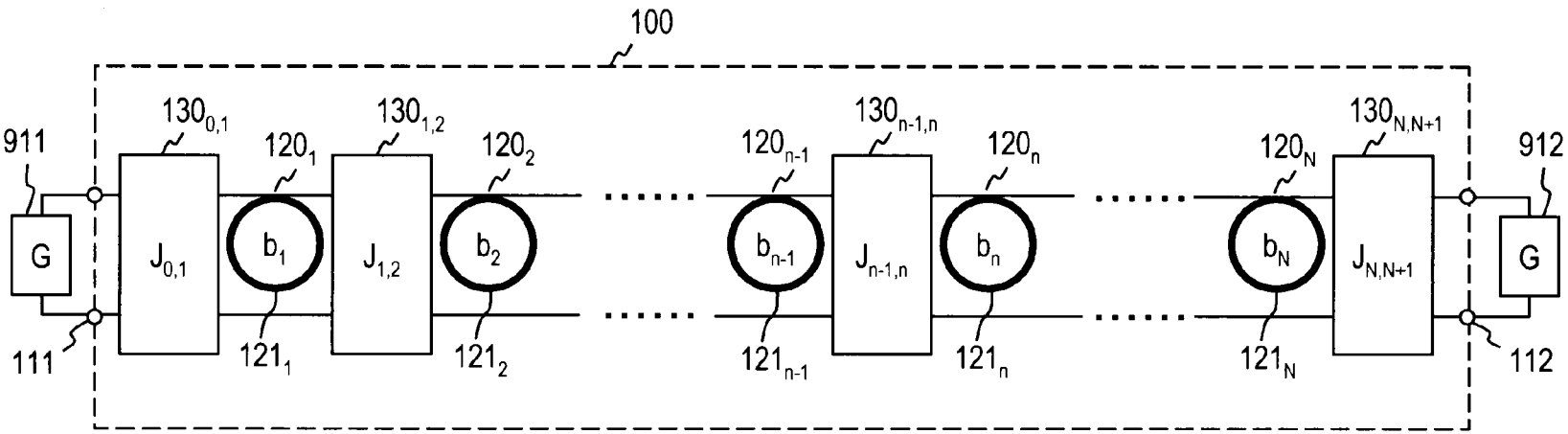
FIG. 4 is a diagram showing a section of the signal selecting device that includes resonating parts and impedance transforming parts.
Figure 5:
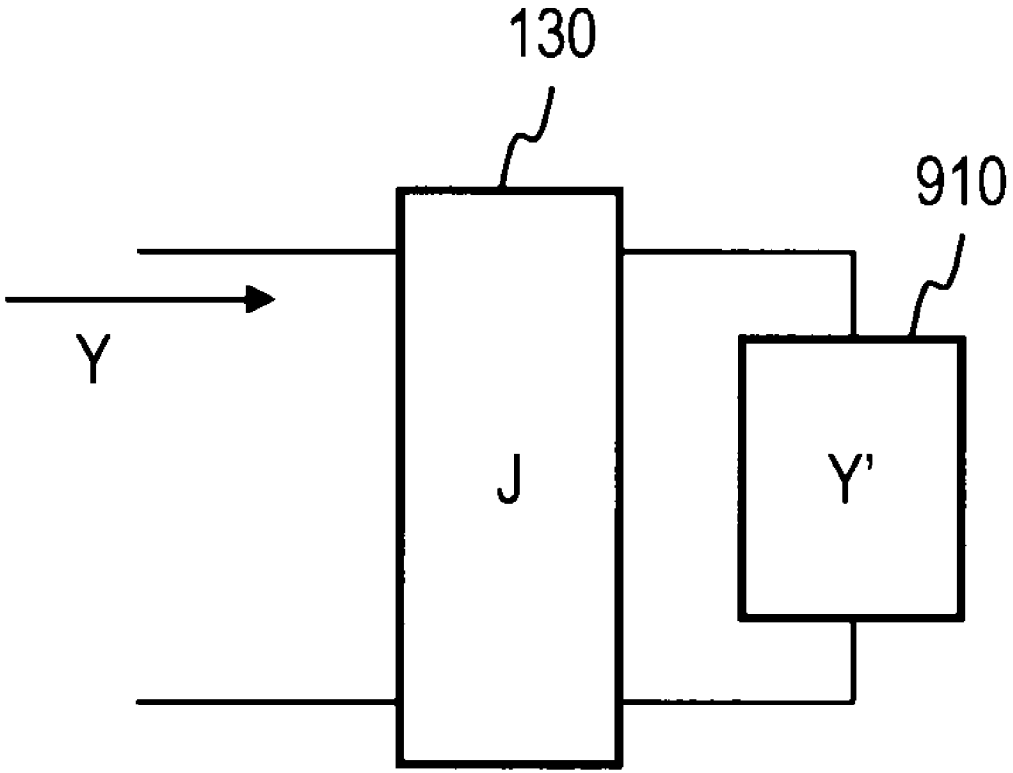
FIG. 5 is a diagram for explaining characteristics of a typical J-inverter.

FIG. 4 is a diagram showing a section of the signal selecting device shown in FIG. 1 that includes the resonating parts and the impedance transforming parts. There are N resonating parts $\mathbf{120}_1$ to $\mathbf{120}_N$ and N+1 impedance transforming parts $\mathbf{130}_{0,1}$ to $\mathbf{130}_{N,N+1}$. The impedance transforming parts $\mathbf{130}_{0,1}$ to $\mathbf{130}_{N,N+1}$ are disposed between the input/output ports 111 and 112 in such a manner that the impedance transforming part $\mathbf{130}_{0,1}$ is disposed between the input/output port 111 and the resonating part $\mathbf{120}_1$, the impedance transforming part $\mathbf{130}_{N,N+1}$ is disposed between the input/output port 112 and the resonating part $\mathbf{120}_N$, and the remaining impedance transforming parts $\mathbf{130}_{1,2}$ to $\mathbf{130}_{N-1,N}$ are disposed between the remaining resonating parts. Admittance 911 and 912 are port admittances of the input/output ports 111 and 112, respectively. The impedance transforming parts $\mathbf{130}_{0,1}$ to $\mathbf{130}_{N,N+1}$ transform the impedance of a component connected thereto (a circuit or an element, for example) to an impedance that is proportional to the inverse thereof. The ring conductor $\mathbf{121}_n$ of the resonating part $\mathbf{120}_n$ used in the signal selecting device 100 is connected in parallel with a transmission line that connects the impedance transforming part $\mathbf{130}_{n-1,\,n}$ and the impedance transforming part $\mathbf{130}_{n,n+1}$. The impedance transforming parts $\mathbf{130}_{0,1}$ to $\mathbf{130}_{N,N+1}$ in this case are referred to as admittance inverter or J-inverter. FIG. 5 is a diagram for explaining the characteristics of a typical J-inverter. The characteristics of the J-inverter shown in this drawing is expressed by the following formula.

$$Y = \frac{J^2}{Y'} \tag{3}$$

That is, the admittance parameter J of the J-inverter is a coefficient that determines the number by which the admittance inverted by the J-inverter is multiplied.

The admittance parameter $J_{n-1,n}$ of the impedance transforming part $\mathbf{130}_{n-1,n}$ are expressed by the following formulas using the bandwidth (fractional bandwidth), the in-band and the out-band characteristics.

$$J_{0,1} = \sqrt{\frac{Gb_1 w}{g_0 g_1}} \tag{4}$$

$$J_{n-1,n} = w\sqrt{\frac{b_{n-1} b_n}{g_{n-1} g_n}} \tag{5}$$

$$J_{N,N+1} = \sqrt{\frac{Gb_N w}{g_N g_{N+1}}} \tag{6}$$

In these formulas, G denotes the port admittance, and $b_n$ denotes the susceptance slope parameter of the n-th resonating part $\mathbf{120}_n$. w denotes the fractional bandwidth of the signal selecting device 100, $g_n$ denotes an element value of an original low pass filter, and these values determine the bandwidth and the in-band and out-band characteristics of the signal selecting device 100. When these parameters satisfy the relationships expressed by the formulas (4) to (6), the signal selecting device 100 has desired characteristics. Of these parameters, the fractional bandwidth w and the element value $g_n$ of the original low pass filter are determined from the characteristics of the signal selecting device 100 to be achieved. The port admittance G depends on the circuits preceding and following the signal selecting device 100. Therefore, the admittance parameter $J_{n-1,n}$ or the susceptance slope parameter $b_n$ can be adjusted to satisfy the relationship expressed by the formulas (4) to (6).

Conventional signal selecting devices (filters) cannot arbitrarily change the susceptance slope parameter $b_n$. Therefore, after the fractional bandwidth w and the element value $g_n$ of the original low pass filter are determined, the admittance parameter $J_{n-1,n}$ that satisfies the formulas (4) to (6) has to be designed with the susceptance slope parameter $b_n$ being fixed. In addition, conventionally, a capacitor is often used as the J-inverter. However, if the bandwidth is changed by changing the capacitance of the capacitor, the operational frequency of the J-inverter also changes. That is, the center frequency also changes. Therefore, it is difficult to design the J-inverter that satisfies the formulas (4) to (6).

To the contrary, the signal selecting device 100 according to the present invention has the resonating part $\mathbf{120}_n$ incorporating the ring conductor $\mathbf{121}_n$ and therefore can arbitrarily change the susceptance slope parameter $b_n$. That is, the characteristics of the signal selecting device 100 can be changed by changing the susceptance slope parameter $b_n$ of the resonating part $\mathbf{120}_n$. Therefore, in case of designing of the signal selecting device 100, the fractional bandwidth w and the element value $g_n$ of the original low pass filter are determined and the admittance parameter $J_{n-1,n}$ is calculated from the characteristics of the circuit of the impedance transforming part $\mathbf{130}_{n-1,n}$ (J-inverter). Then, the switch to be turned on can be selected among the switches $\mathbf{122}_n$-1 to $\mathbf{122}_n$-M so that the susceptance slope parameter $b_n$ satisfies the formulas (4) to (6). That is, the condition that the formulas (4) to (6) have to be satisfied does not have to be considered in design of the J-inverter, so that the J-inverter can be easily designed.

Furthermore, when the bandwidth and the in-band and out-band characteristics are to be changed, the switch $\mathbf{122}_1$-1 to $\mathbf{122}_N$-M to be turned on can be changed to meet the desired characteristics. In this case, the resonant frequency of the resonating part $\mathbf{120}_n$ does not change, and the admittance parameter $J_{n-1,n}$ also does not change, so that the center frequency can be kept constant. In actual, the number of switches is finite, so that the possible susceptance slope parameters $b_n$ are discrete. Therefore, a switch $\mathbf{122}_1$-1 to $\mathbf{122}_N$-M that provides a value closest to the required susceptance slope parameter $b_n$ is selected.

As described above, in a signal selecting device according to the embodiment 1, the resonating part having the ring conductor and the switches can arbitrarily change the susceptance slope parameter highly independently of the resonant frequency. Therefore, the signal selecting device can be easily designed to have desired characteristics. In addition, the bandwidth and the characteristics can be changed by changing the susceptance slope parameter of the resonating part.

Embodiment 2

Figure 6:
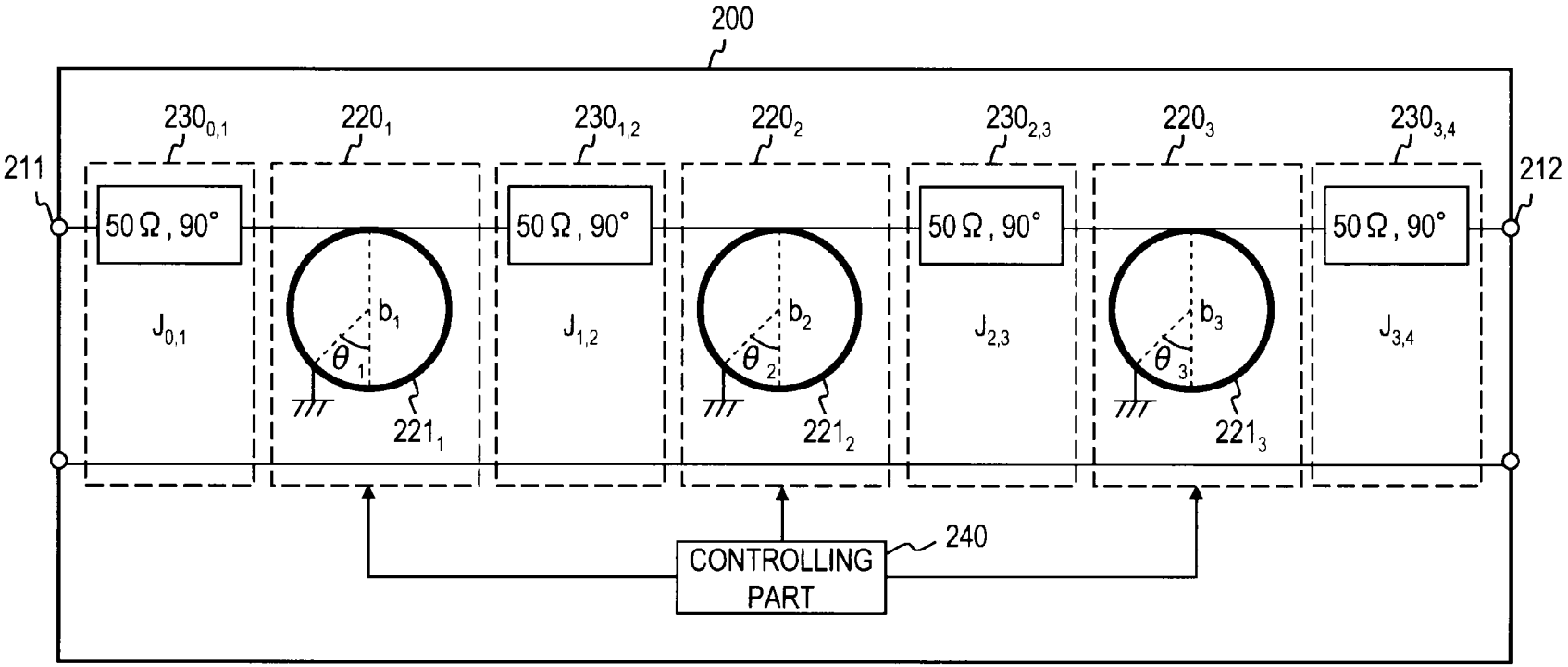
FIG. 6 is a diagram showing an exemplary functional configuration of a signal selecting device according to an embodiment 2.

In the embodiment 1, a signal selecting device according to the present invention has been generally described. In an embodiment 2, a signal selecting device according to the present invention will be specifically described. FIG. 6 is a diagram showing an exemplary functional configuration of a signal selecting device according to the embodiment 2. A signal selecting device 200 has input/output ports 211 and 212, three resonating parts $\mathbf{220}_1$ to $\mathbf{220}_3$, four impedance transforming parts $\mathbf{230}_{0,1}$ to $\mathbf{230}_{3,4}$, and a controlling part 240. The resonating part $\mathbf{220}_n$ has a ring conductor $\mathbf{221}_n$. Although not shown in FIG. 6, the resonating part $\mathbf{220}_n$ has switches as in the embodiment 1. The input/output ports 211 and 212 have a port impedance of 50Ω. The resonating part $\mathbf{220}_n$ has a resonant frequency of 5 GHz, and the ring conductor $\mathbf{221}_n$ has a characteristic impedance of 50Ω. For the convenience of explanation, it is assumed that the position of grounding of the resonator is changed instead of selecting the switch to be turned on. The positions of the switches are shown by $\theta_1$ to $\theta_3$ in the drawing. The impedance transforming parts $\mathbf{230}_{0,1}$ to $\mathbf{230}_{3,4}$ are transmission lines, which have a characteristic impedance of 50Ω and a length equal to a quarter of the wavelength at 5 GHz. At this time, the admittance parameter of the impedance transforming parts $\mathbf{230}_{0,1}$ to $\mathbf{230}_{3,4}$ is 0.02 S. In addition, since the port impedance is 50Ω, the port admittance is 0.02 S.

Next, there will be specifically described a way of changing the positions $\theta_1$ to $\theta_3$ of the switches when the characteristics to be achieved of the signal selecting device 200 is changed. For example, there will be considered three cases where the characteristics to be achieved of the signal selecting device 200 are Butterworth characteristics with a fractional bandwidth of 3%, Butterworth characteristics with a fractional bandwidth of 5%, and Chebyshev characteristics (with a ripple of 0.1 dB) with a fractional bandwidth of 3%. In any of the cases, the center frequency is supposed to be 5 GHz.

First, two cases where the signal selecting device has Butterworth characteristics will be considered. In the case of the Butterworth characteristics, the element values $g_0$ to $g_4$ of the original low pass filters of the three resonating part $\mathbf{220}_1$ to $\mathbf{220}_3$ are 1, 1, 2, 1 and 1, respectively. For the cases where the fractional bandwidth is 0.03 (3%) and 0.05 (5%), the susceptance slope parameters $b_1$ to $b_3$ are determined using the formulas (4) to (6). Then, in the case where the fractional bandwidth is 3%, $b_1$=0.67, $b_2$=1.33, and $b_3$=0.67. In the case where the fractional bandwidth is 5%, $b_1$=0.4, $b_2$=0.8, and $b_3$=0.4. Then, the grounding positions $\theta_1$ to $\theta_3$ that provide these values are determined. The susceptance slope parameters $b_1$ to $b_3$ and the grounding positions $\theta_1$ to $\theta_3$ are shown by the formula (2) and in FIG. 3. The grounding positions $\theta_1$ to $\theta_3$ determined using FIG. 3 are about 18 degrees, 13 degrees and 18 degrees, respectively, in the case where the fractional bandwidth is 3%, and about 23 degrees, 16 degrees and 23 degrees, respectively, in the case where the fractional bandwidth is 5%.

Next, the case where the signal selecting device has Chebyshev characteristics, and the fractional bandwidth to be achieved is 3% will be considered. In the case of the Chebyshev characteristics with a ripple of 0.1 dB, the element values $g_0$ to $g_4$ of the original low pass filters of the three resonating part 220$_1$ to 220$_3$ are 1, 1.0315, 1.1474, 1.0315 and 1, respectively. Based on the fractional bandwidth of 0.03 (3%), the susceptance slope parameters $b_1$ to $b_3$ are determined using the formulas (4) to (6). Then, $b_1$=0.69, $b_2$=0.76, and $b_3$=0.69. From FIG. 3, the grounding positions $\theta_1$ to $\theta_3$ that provide these susceptance slope parameters determined from FIG. 3 are about 17 degrees, 17 degrees and 17 degrees, respectively.

Figure 7:
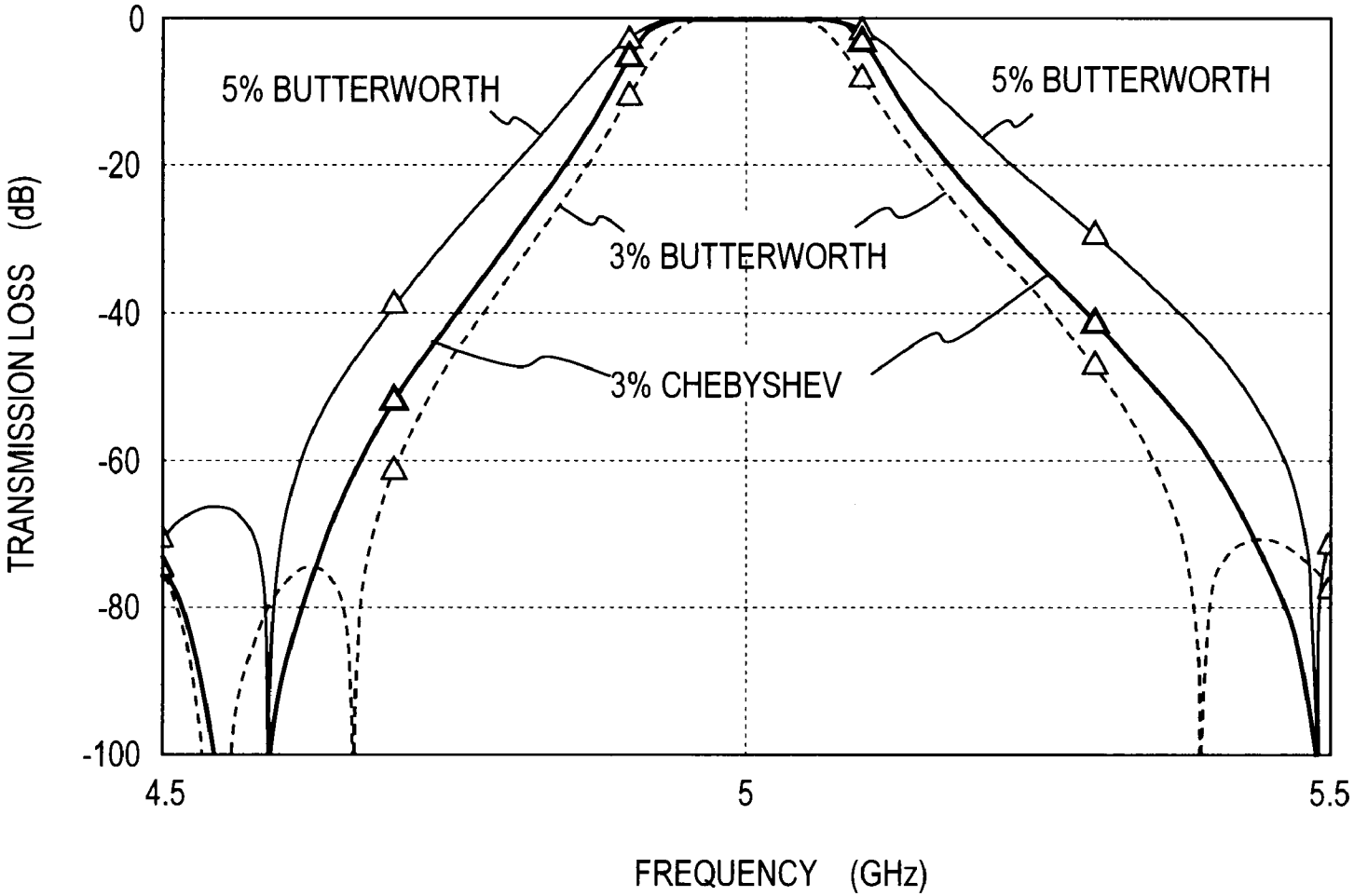
FIG. 7 is a graph showing frequency characteristics of the signal selecting device grounded at determined positions.

FIG. 7 shows frequency characteristics of the signal selecting device 200 grounded at the positions determined as described above. In this way, switching among the Butterworth characteristics with the fractional bandwidth of 3%, the Butterworth characteristics with the fractional bandwidth of 5% and the Chebyshev characteristics (with a ripple of 0.1 dB) with the fractional bandwidth of 3% can be achieved by changing the grounding positions. That is, it can be seen that the in-band and out-band characteristics can be changed by selecting the switch to be turned on. The grounding positions can also be determined in an analytical manner instead of using a graph as in this embodiment.

Embodiment 3

Figure 8:
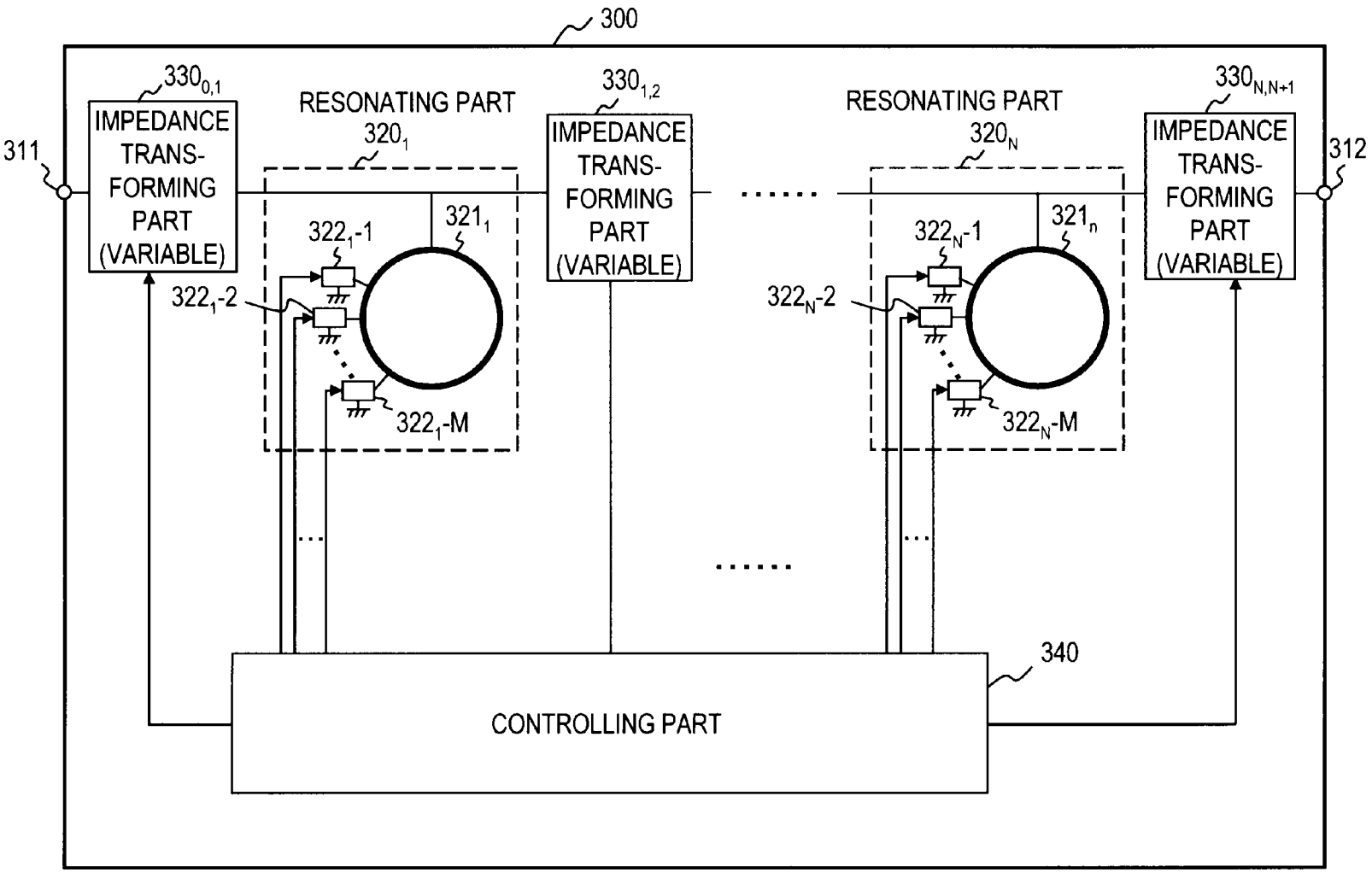
FIG. 8 is a diagram showing an exemplary functional configuration of a signal selecting device according to an embodiment 3.

In the embodiment 2, all the impedance transforming parts have the same, fixed characteristics. If such identical impedance transforming parts are used in this way, the signal selecting device can be easily designed and fabricated. However, the impedance transforming parts do not always have to have the same characteristics but can have different characteristics or variable characteristics. FIG. 8 is a diagram showing an exemplary functional configuration of a signal selecting device according to an embodiment 3. A signal selecting device 300 has two input/output ports 311 and 312, N resonating parts 320$_1$ to 320$_N$, N+1 impedance transforming parts 330$_{0,1}$ to 230$_{N,N+1}$ capable of changing the characteristics, and a controlling part 340. While all the impedance transforming parts 330$_{0,1}$ to 330$_{N,N+1}$ are shown as being capable of changing the characteristics in FIG. 8, only one particular impedance transforming part may be capable of changing the characteristics. The resonating part 320$_n$ has a ring conductor 321$_n$ having a length equal to one wavelength at a resonant frequency or an integral multiple thereof, and M switches 322$_n$-1 to 322$_n$-M each of which is connected to a different part of the ring conductor 321$_n$ at one end thereof and to a ground conductor at the other end thereof. The controlling part 340 controls the state of the N*M switches 322$_1$-1 to 322$_N$-M and the characteristics of the impedance transforming parts 330$_{0,1}$ to 330$_{N,N+1}$. The resonating parts 320$_1$ to 320$_N$ are disposed in series between the two input/output ports. The impedance transforming parts 330$_{0,1}$ to 330$_{N,N+1}$ are disposed between the input/output ports in such a manner that the impedance transforming parts 130$_{0,1}$ and 130$_{N,N+1}$ at the both ends are disposed between the input/output port and the resonating part and the remaining impedance transforming parts 130$_{1,2}$ to 130$_{N-1,N}$ are disposed between the resonating parts. The configuration shown in FIG. 8 has a high design flexibility and facilitate achievement of desired filter characteristics. In the two examples described below, the impedance transforming parts 330$_{0,1}$ to 330$_{N,N+1}$ (J-inverters) need to have variable characteristics.

Figure 9:
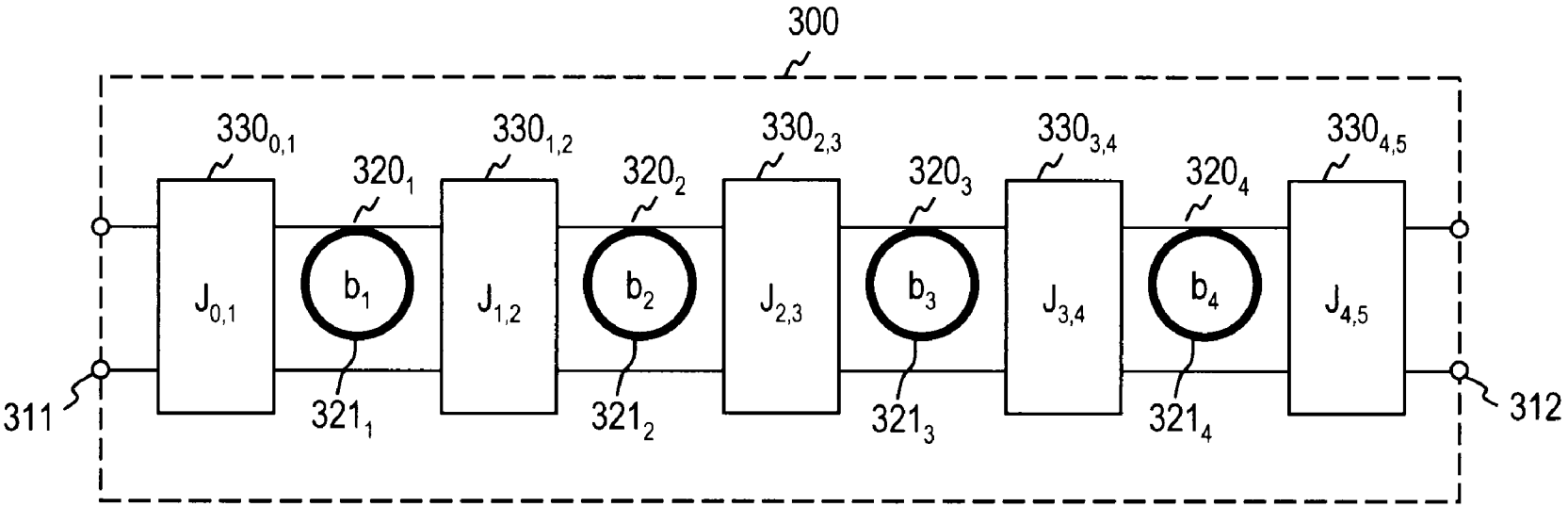
FIG. 9 is a diagram showing a section of the signal selecting device having four resonating parts and five impedance transforming parts that includes the resonating parts and the impedance transforming parts.

One example is a case where an even number of resonating parts are used. In this specification, a signal selecting device using four resonating parts and five impedance transforming parts will be described. FIG. 9 shows a section of the signal selecting device 300 shown in FIG. 8 having four resonating parts and five impedance transforming parts that includes the resonating parts and the impedance transforming parts. For example, the signal selecting device 300 having four resonating parts 320$_1$ to 320$_4$ is designed to have Chebyshev characteristics with a center frequency of 5 GHz, a fractional bandwidth of 5% and a ripple of 0.1 dB. The element value $g_0$ to $g_5$ of the original low pass filters are 1, 1.1088, 1.3061, 1.77.3, 0.8180 and 1.3554, respectively. The fractional bandwidth is 0.05. In the embodiment 2, each susceptance slope parameter $b_n$ is determined on the assumption that the admittance parameter is 0.02 S because all the impedance transforming parts (J-inverters) are quarter-wave transmission lines having a characteristic impedance of 50Ω. However, in the case of the signal selecting device having four resonating parts, the solutions that satisfy the formulas (4) to (6) cannot be found if the same admittance parameter is substituted in the formulas. This is because the element values $g_n$ of the original low pass filters are not symmetrical if there are an even number of stages of components having Chebyshev characteristics. In other words, the sequence of the element values $g_n$ of the original low pass filters viewed from the leading end differs from the sequence of the same element values $g_n$ viewed from the trailing end. Thus, in order to satisfy all the relationships expressed by the formulas (4) to (6), the admittance parameter of at least one impedance transforming part has to be different from that of the other impedance transforming parts. In the case of the Butterworth characteristics, the sequence of the element values of the original low pass filters is always symmetrical, and therefore, all the impedance transforming parts can have the same admittance parameter.

That is, in order for the signal selecting device having an even number of resonating parts to switch between the Chebyshev characteristics and Butterworth characteristics, at least one impedance transforming part has to be variable. Any of the impedance transforming parts can be variable. However, the central impedance transforming part is preferably variable because the central impedance transforming part can change the filter characteristics widely. The reason for this will be described in detail with reference to FIG. 9. First, in the case where the impedance transforming part 330$_{4,5}$ closest to the input/output port is variable, to achieve Chebyshev characteristics with a fractional bandwidth of 5% and a ripple of 0.1 dB, the admittance parameter is 0.017, and the susceptance slope parameters $b_1$ to $b_4$ are 0.444, 0.522, 0.708 and 0.327, respectively. Next, in the case where the impedance transforming part 330$_{3,4}$ next closest to the input/output port is variable, the admittance parameter is 0.023, and the susceptance slope parameters $b_1$ to $b_4$ are 0.444, 0.522, 0.708 and 0.443, respectively. In the case where the central impedance transforming part 330$_{2,3}$ is variable, the admittance parameter is 0.017, and the susceptance slope parameters $b_1$ to $b_4$ are 0.444, 0.522, 0.522 and 0.443, respectively. As can be seen, the susceptance slope parameters $b_1$ to $b_4$ in the case where the central impedance transforming part $330_{2,3}$ is variable are less variable than the susceptance slope parameters $b_1$ to $b_4$ in the cases where the impedance transforming part $330_{4,5}$ is variable and where the impedance transforming part $330_{3,4}$ is variable. The susceptance slope parameters $b_1$ to $b_4$ of the resonating parts $320_1$ to $320_4$ vary with the grounding position and reach a maximum value when θ is 90 degrees. However, the value depends on the characteristic impedances of the ring-shaped lines forming the respective resonating part, and therefore, if the resonating part is formed by a line having a fixed characteristic impedance, the maximum value is set during design and cannot be changed. As the variation of the susceptance slope parameters $b_1$ to $b_4$ becomes smaller, the range to which the resonating parts can be applied becomes wider. Thus, when the central impedance transforming part $330_{2,3}$ is variable, the range of the filter characteristics variation is widest.

As described above, in addition to achieving the same effect as a signal selecting device according to the embodiment 1, the signal selecting device according to the embodiment 3 can increase the design flexibility and enable switching between Chebyshev characteristics and Butterworth characteristics in case of the signal selecting device having an even number of resonating parts.

Embodiment 4

Figure 10:
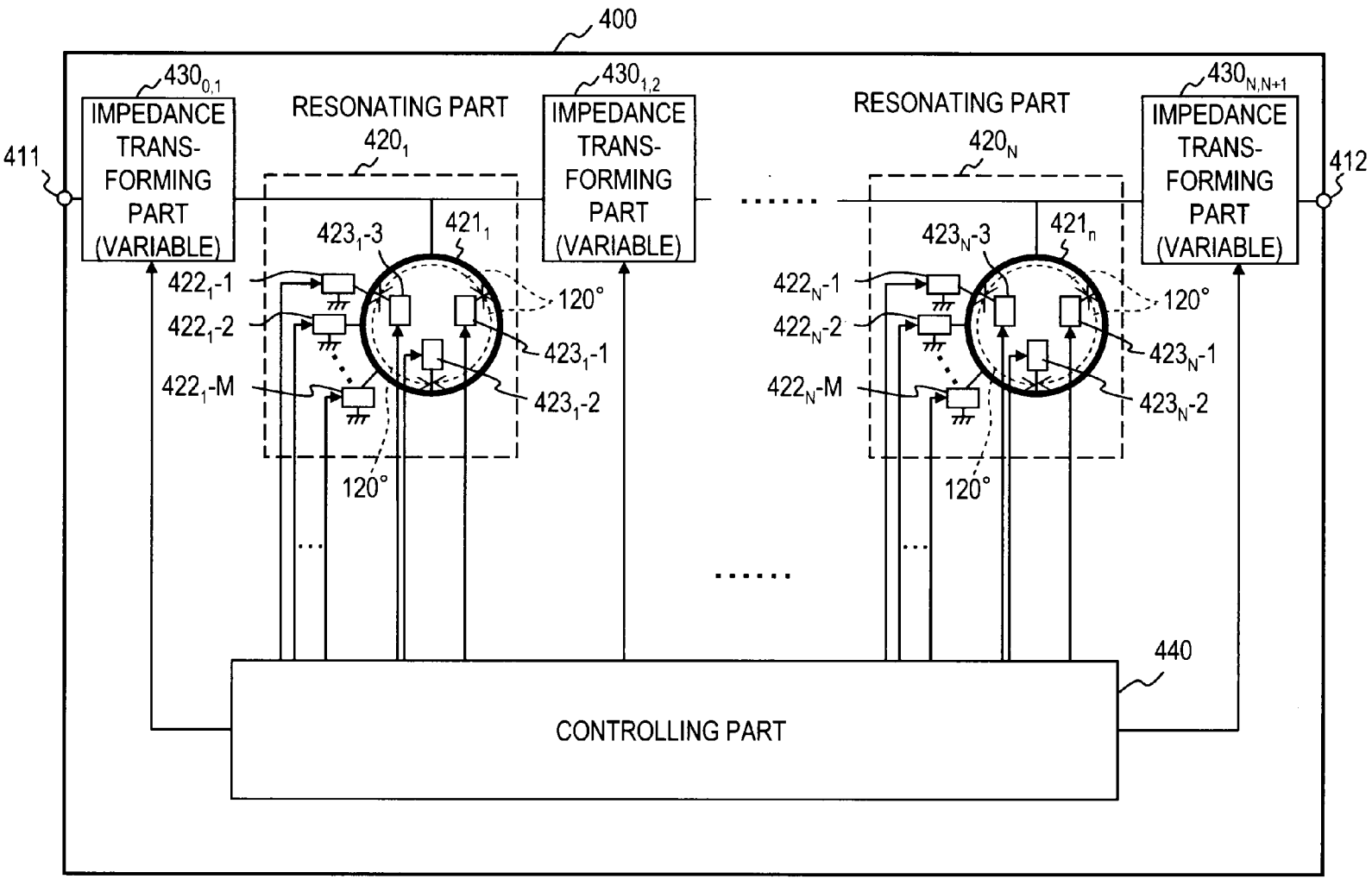
FIG. 10 is a diagram showing an exemplary functional configuration of a signal selecting device according to an embodiment 4.

In the embodiment 3, one of the cases where the impedance transforming parts need to have variable characteristics has been described. In this embodiment 4, the other of the cases will be described. FIG. 10 is a diagram showing an exemplary functional configuration of a signal selecting device according to the embodiment 4. A signal selecting device 400 has two input/output ports 411 and 412, N resonating parts $420_1$ to $420_N$, N+1 impedance transforming parts $430_{0,1}$ to $430_{N,N+1}$ capable of changing the characteristics, and a controlling part 440. The resonating part $420_n$ has a ring conductor $421_n$ having a length equal to one wavelength at a resonant frequency or an integral multiple thereof, M switches $422_n$-1 to $422_n$-M each of which is connected to a different part of the ring conductor $421_n$ at one end thereof and to a ground conductor at the other end thereof, and three variable reactance means $423_n$-1 to $423_n$-3 connected to the ring conductor $421_n$ at regular intervals. The controlling part 440 controls the state of the N*M switches $422_1$-1 to $422_N$-M, the characteristics of the impedance transforming parts $430_{0,1}$ to $430_{N,N+1}$ and the characteristics of the variable reactance means $423_1$-1 to $423_N$-3. The resonating parts $420_1$ to $420_N$ are disposed in series between the two input/output ports. The impedance transforming parts $430_{0,1}$ to $430_{N,N+1}$ are disposed between the input/output ports in such a manner that the impedance transforming parts $430_{0,1}$ and $430_{N,N+1}$ at the both ends are disposed between the input/output port and the resonating part and the remaining impedance transforming parts $430_{1,2}$ to $430_{N-1,N}$ are disposed between the resonating parts. In this embodiment, if the ring conductors $421_n$ have the same characteristic impedance, the signal selecting device can be easily designed.

The resonating part $420_n$ of the signal selecting device 400 has three variable reactance means $423_n$-1 to $423_n$-3 connected to the ring conductor $421_n$ at regular intervals. Therefore, the signal selecting device 400 can change the resonant frequency and the zero point highly independently. To change the resonant frequency, the impedance has to be appropriately changed at the respective resonant frequencies, so that the impedance transforming parts $430_{0,1}$ to $430_{N,N+1}$ also have to be variable.

As described above, since each resonating part has the variable reactance means connected to the ring conductor at appropriate intervals, the center frequency can be changed highly independently of the bandwidth and the in-band and out-band characteristics. Furthermore, the variable impedance transforming circuits allows appropriate adjustment of the bandwidth and the in-band and out-band characteristics.

While the signal selecting device has been described as having three variable reactance means in this embodiment, the same effect can be achieved if the signal selecting device has four or more variable reactance means.

Figure 11:
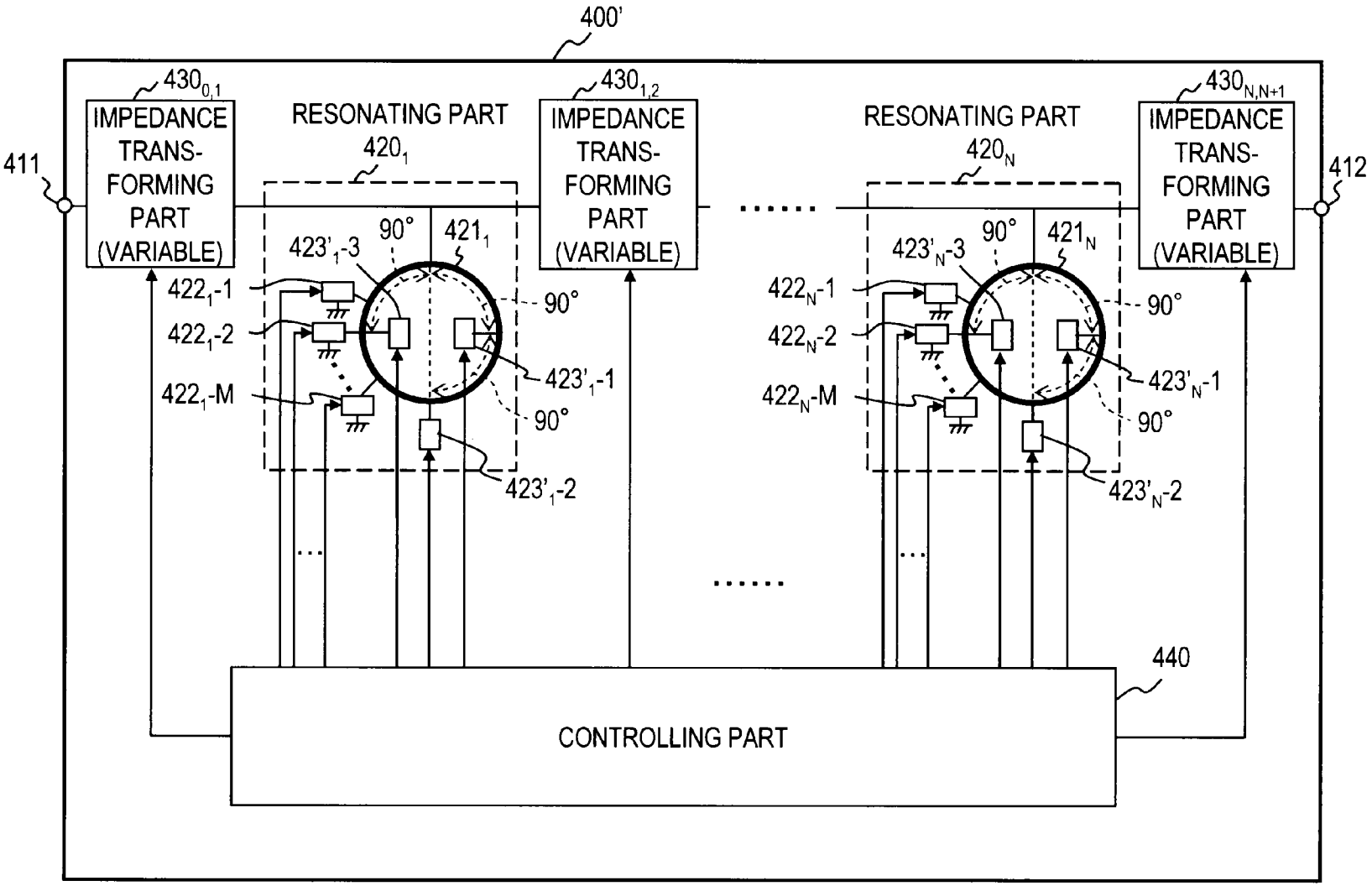
FIG. 11 is a diagram showing an exemplary configuration in which arrangement of variable reactance means is modified.

FIG. 11 shows a modified configuration of the signal selecting device shown in FIG. 10 in which the variable reactance means are not disposed at regular intervals. With the configuration shown in FIG. 11, the center frequency, the bandwidth and the in-band and out-band frequency characteristics can be changed by appropriately designing the positions of the variable reactance means and the reactances thereof. For example, in the case of a signal selecting device 400', the reactance of the variable reactance means $423_n$-2 can be set at a half the value of the variable reactance means $423_n$-1 and $423_n$-3. In this way, even if the arrangement of the variable reactance means changes, the same effect as that of the signal selecting device 400 can be achieved. In addition, the number of the variable reactance means of the signal selecting device 400' is not limited to three, and the same effect can be achieved if the signal selecting device 400' have four or more variable reactance means.

Embodiment 5

Figure 12:
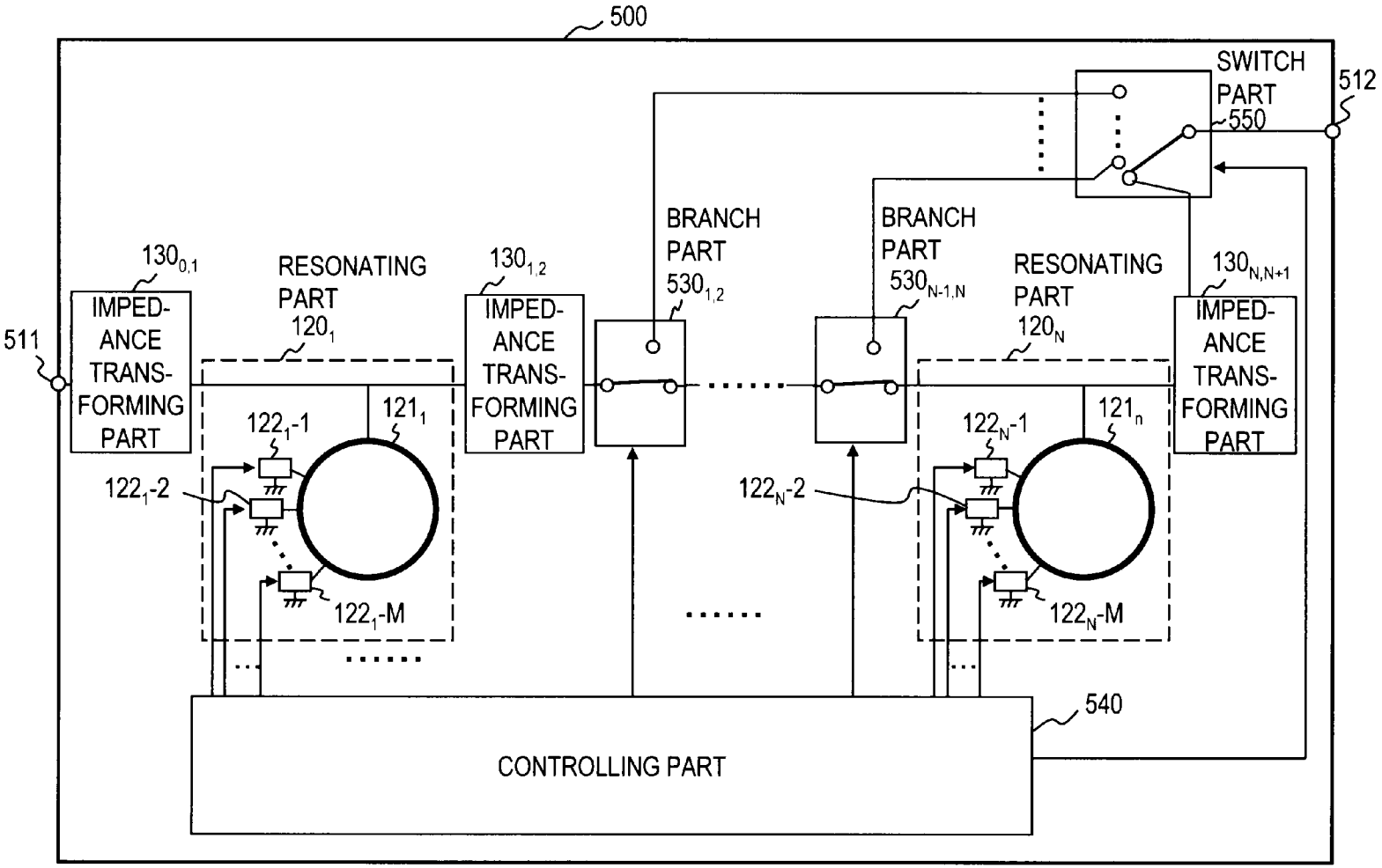
FIG. 12 is a diagram showing an exemplary functional configuration of a signal selecting device according to an embodiment 5.

FIG. 12 is a diagram showing an exemplary functional configuration of a signal selecting device according to an embodiment 5. A signal selecting device 500 has the configuration of the signal selecting device 100 according to the embodiment 1 additionally provided with N−1 branch parts and a switch part. Specifically, a signal selecting device 500 has two input/output ports 511 and 512, N resonating parts $120_1$ to $120_N$, N+1 impedance transforming parts $130_{0,1}$ to $130_{N,N+1}$, a controlling part 540, N−1 branch parts $530_{1,2}$ to $530_{N-1,N}$, and a switch part 550. The branch part $530_{n,n+1}$ has three terminals and switches the state of connection between a predetermined terminal (one terminal) and the remaining terminals (two terminals). The switch part 550 has N+1 terminals and switches the state of connection between a predetermined terminal (one terminal) and the remaining terminals (N terminals). The predetermined terminal of the switch part 550 is connected to the input/output port 512, and one of the remaining terminals is connected to the impedance transforming part $130_{N,N+1}$ (or, in other words, disposed between the input/output port 512 and the impedance transforming part $130_{N,N+1}$). The predetermined terminal of the branch part $530_{n,n+1}$ is connected to the impedance transforming part $130_{n,n+1}$ (on the side of the input/output port 511), and one of the remaining terminals is connected to the resonating part $120_{n+1}$ (or, in other words, disposed between the impedance transforming part $130_{n,n+1}$ and the resonating part $120_{n+1}$). The other of the remaining terminals of the branch part $530_{n,n+1}$ is connected to one of the remaining terminals of the switch part 550. The controlling part 540 controls the state of the N*M switches $122_1$-1 to $122_N$-M, the state of connection of the branch parts $530_{1,2}$ to $530_{N-1,N}$ and the state of connection of the switch part 550.

For example, in the case where all the branch parts $530_{n,n+1}$ connect the impedance transforming parts $130_{n,n+1}$ to the resonating parts $120_{n+1}$, and the switch part 550 connects the impedance transforming part $130_{N,N+1}$ to the input/output port 512, the signal selecting device 500 functions as a signal selecting device having N resonators. In the case where one branch part $\mathbf{530}_{n,n+1}$ connects the impedance transforming part $\mathbf{130}_{n,n+1}$ to the switch part 550, and the switch part 550 connects the impedance transforming part $\mathbf{130}_{n,n+1}$ to the input/output port 512, the signal selecting device 500 functions as a signal selecting device having n resonators. That is, the number of resonators can be changed by controlling which branch part $\mathbf{530}_{n,n+1}$ is connected to the switch part 550. Therefore, the bandwidth and the in-band and out-band frequency characteristics can be more flexibly adjusted.

Embodiment 6

Figure 13:
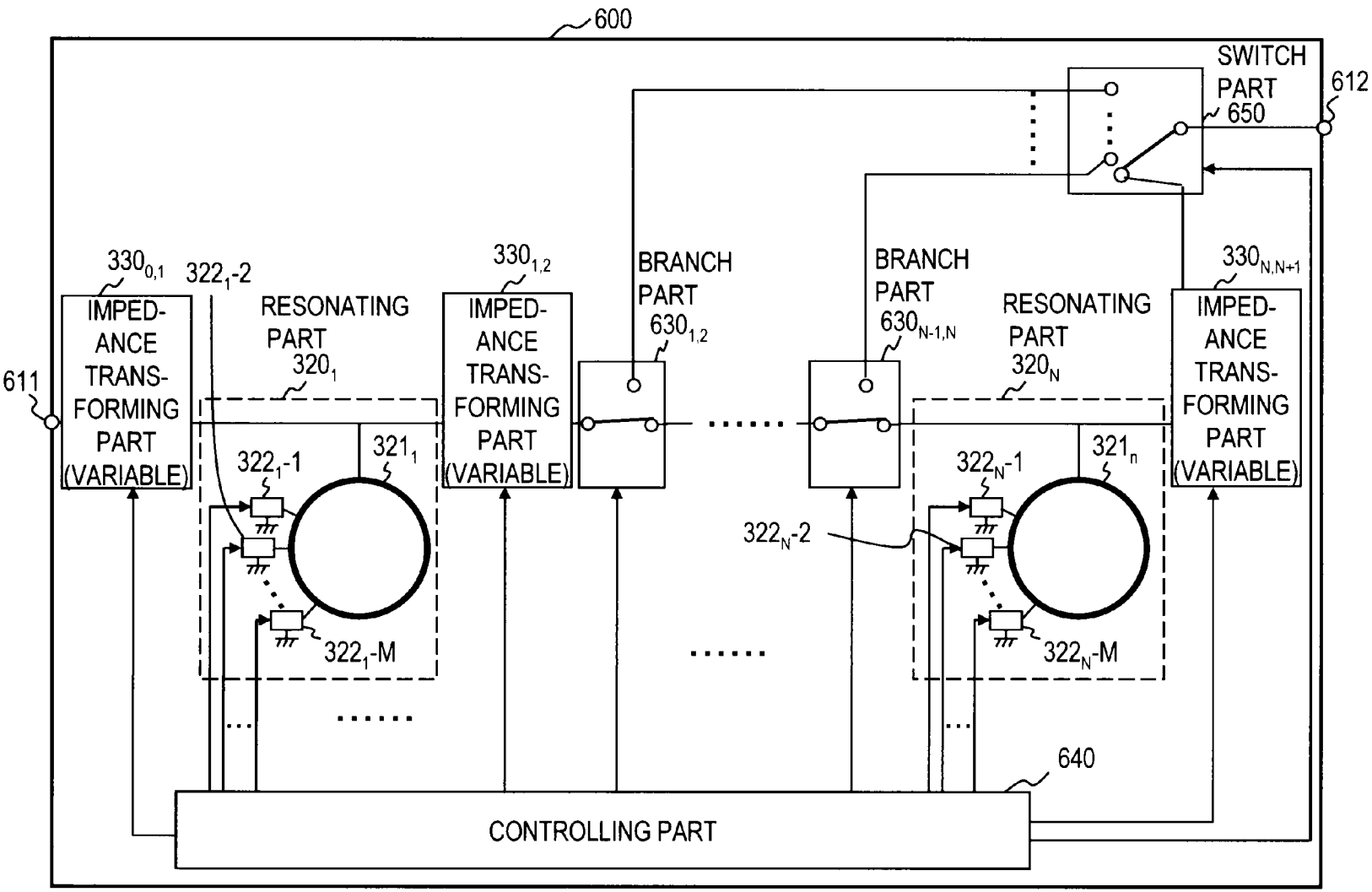
FIG. 13 is a diagram showing an exemplary functional configuration of a signal selecting device according to an embodiment 6.

FIG. 13 is a diagram showing an exemplary functional configuration of a signal selecting device according to an embodiment 6. A signal selecting device 600 has the configuration of the signal selecting device 300 according to the embodiment 3 additionally provided with N−1 branch parts $\mathbf{630}_{1,2}$ to $\mathbf{630}_{N-1,N}$ and a switch part 650. The way of connection between the branch parts $\mathbf{630}_{1,2}$ to $\mathbf{630}_{N-1,N}$ and the switch part 650, the way of control, and the effects are the same as those in the embodiment 5.

Embodiment 7

Figure 14:
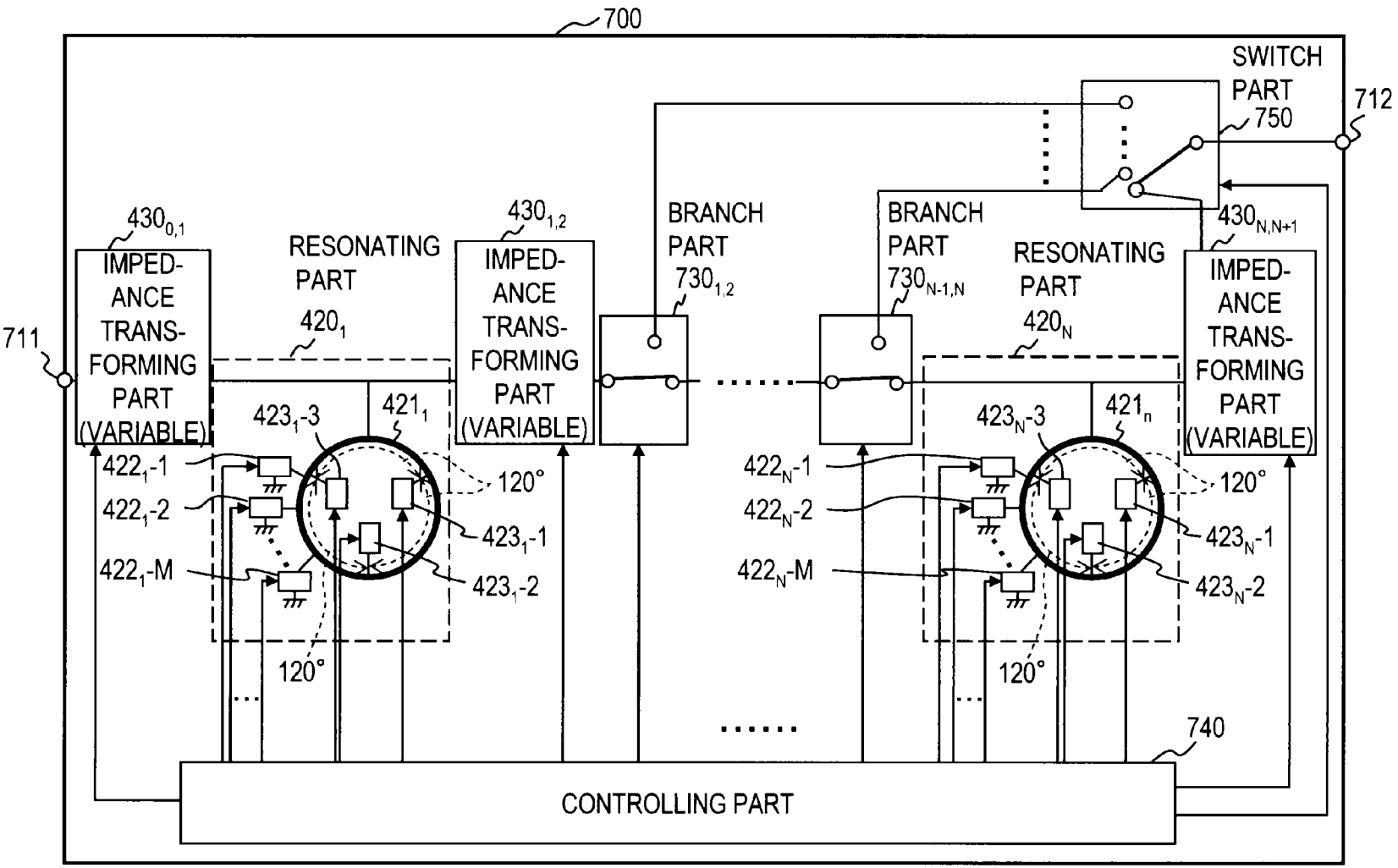
FIG. 14 is a diagram showing an exemplary functional configuration of a signal selecting device according to an embodiment 7.

FIG. 14 is a diagram showing an exemplary functional configuration of a signal selecting device according to an embodiment 7. A signal selecting device 700 has the configuration of the signal selecting device 400 according to the embodiment 4 additionally provided with N−1 branch parts $\mathbf{730}_{1,2}$ to $\mathbf{730}_{N-1,N}$ and a switch part 750. The way of connection between the branch parts $\mathbf{730}_{1,2}$ to $\mathbf{730}_{N-1,N}$ and the switch part 750, the way of control, and the effects are the same as those in the embodiment 5.

Embodiment 8

Figure 15:
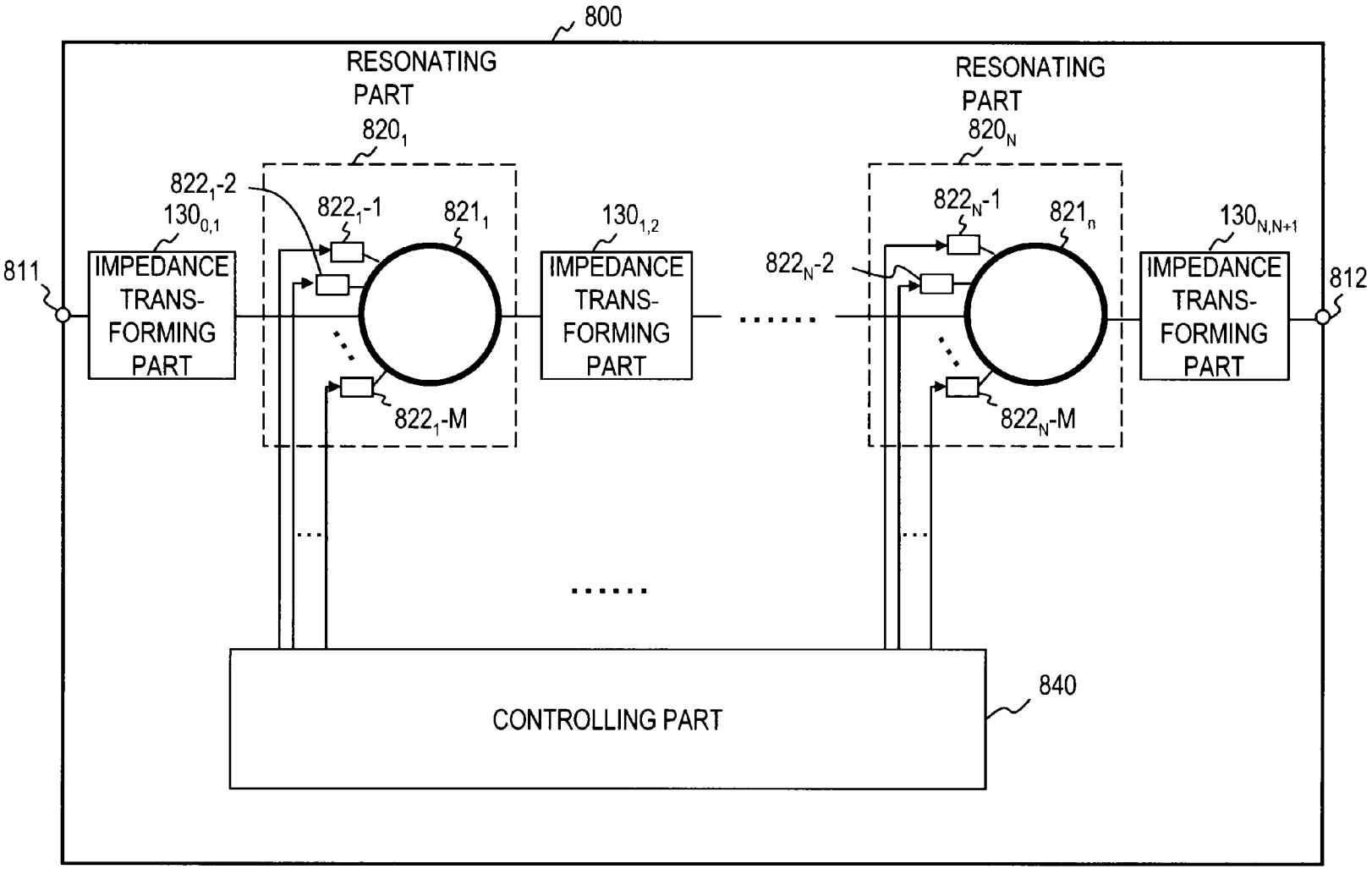
FIG. 15 is a diagram showing an exemplary functional configuration of a signal selecting device according to an embodiment 8.

In the embodiments 1 to 7, the ring conductors are connected in parallel to the signal line. In an embodiment 8, the ring conductors are connected in series to the signal line. FIG. 15 is a diagram showing an exemplary functional configuration of a signal selecting device according to this embodiment. A signal selecting device 800 has the same configuration as the signal selecting device 100 according to the embodiment 1 except that the resonating parts $\mathbf{120}_1$ to $\mathbf{120}_N$ are replaced with resonating parts $\mathbf{820}_1$ to $\mathbf{820}_N$. The resonating part $\mathbf{820}_n$ has a ring conductor $\mathbf{821}_n$ having a length equal to one wavelength at a resonant frequency or an integral multiple thereof and M switches $\mathbf{822}_n$-1 to $\mathbf{822}_n$-M each of which is connected to a different part of the ring conductor $\mathbf{821}_n$ at one end thereof and to a ground conductor at the other end thereof. Two signal lines in the resonating part $\mathbf{820}_n$ are connected to the ring conductor $\mathbf{821}_n$ at positions spaced apart by a distance equal to an integral multiple of a half of the wavelength at the resonant frequency. That is, the two signal lines are connected to the ring conductor $\mathbf{821}_n$ at positions spaced apart by an integral multiple of $\pi$ in terms of electrical length. A switch $\mathbf{822}_n$-m is not limited to a switch capable of simply making a short circuit but can be a switch capable of making a short circuit via a transmission line having a certain line length or a switch capable of establishing a connection of a transmission line having an open end.

If $\theta$ is set at 0, and the part having the impedance $Z_L$ is a signal line in FIG. 2, the resulting resonating part is equivalent to the resonating part $\mathbf{820}_n$. With reference to FIG. 2, it has been described that, when $\theta$=0, the impedance $Z_L$ at the resonant frequency of the resonator $\mathbf{120}_n$ is equal to the input impedance $Z_{in}$. This means that if the part having the impedance $Z_L$ is not a short circuit but a signal line, a signal is transmitted at the resonant frequency, and a filter function (a signal selecting function) is provided. In the case where the ring conductors $\mathbf{821}_n$ are connected in series to each other, the paths in which all the switches $\mathbf{822}_n$-m are in the OFF state have a length equal to an integral multiple of a half of the wavelength at the resonant frequency and, therefore, do not affect the frequency characteristics of the respective resonating parts $\mathbf{820}_n$. Therefore, only the paths that include a switch $\mathbf{822}_n$-m in the ON state affect the frequency characteristics of the respective resonating parts $\mathbf{820}_n$. The frequency characteristics of the resonating part $\mathbf{820}_n$ differs from the frequency characteristics of the resonating part $\mathbf{120}_n$ in this regard.

As described above, in the signal selecting device 800, the resonating parts having a ring conductor and switches can arbitrarily change the susceptance slope parameter highly independently of the resonant frequency, as with the signal selecting device 100 according to the embodiment 1. Therefore, the signal selecting device can be easily designed to have desired characteristics. In addition, the bandwidth and the in-band and out-band characteristics can also changed by changing the susceptance slope parameter of the resonating parts. In practice, in the case where the ring conductors are connected in series, the resonating parts are typically designed using a reactance slope parameter (a parameter in a one-to-one relationship with the susceptance slope parameter).

The signal selecting device 800 shown in FIG. 15 has the configuration of the signal selecting device 100 according to the embodiment 1 in which the resonating parts $\mathbf{120}_1$ to $\mathbf{120}_N$ are replaced with the resonating parts $\mathbf{820}_1$ to $\mathbf{820}_N$. However, the resonating parts of the signal selecting devices 200, 300, 400, 400', 500, 600 and 700 according to the embodiments 2 to 7 can also be replaced with the resonating parts $\mathbf{820}_1$ to $\mathbf{820}_N$. In those cases, the same effect can be achieved.

Specific Examples of Components

Finally, circuits or elements that can be used to form the components shown in the embodiments 1 to 8 will be described.

Figure 16E:
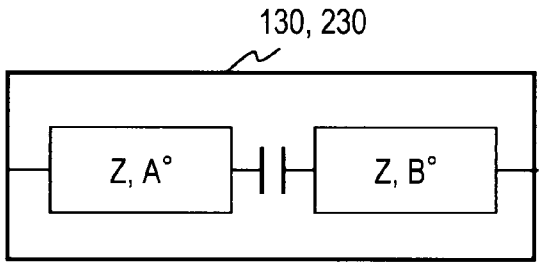
FIG. 16E is a diagram showing an example of the impedance transforming part that is formed by a combination of the examples shown in FIGS. 16A to 16D.
Figure 16A:
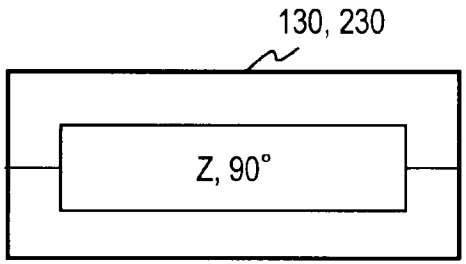
FIG. 16A is a diagram showing an example of the impedance transforming part that is formed by a transmission line having a characteristic impedance of Z and a length equal to a quarter wavelength at a resonant frequency.
Figure 16B:
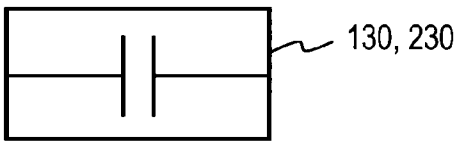
FIG. 16B is a diagram showing an example of the impedance transforming part that is formed by a capacitor.
Figure 16C:
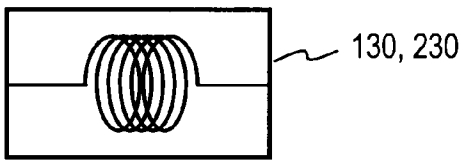
FIG. 16C is a diagram showing an example of the impedance transforming part that is formed by a coil.
Figure 16D:
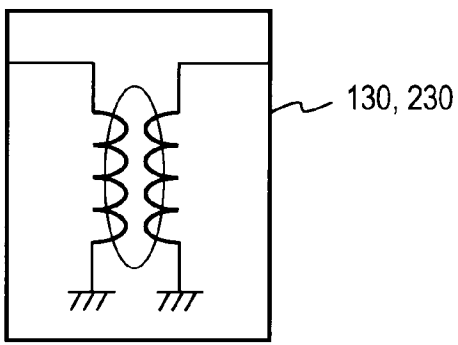
FIG. 16D is a diagram showing an example of the impedance transforming part that is formed by lines coupled by electromagnetic induction.
Figure 17A:
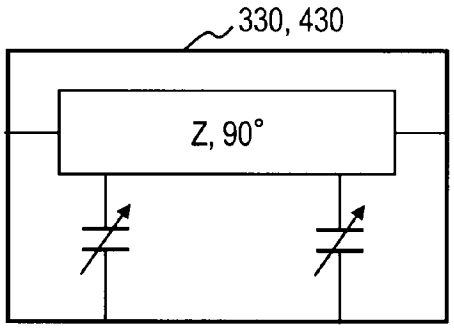
FIG. 17A is a diagram showing an example of an impedance transforming part capable of changing the characteristics that is formed by a transmission line having a characteristic impedance of Z and a length equal to a quarter wavelength at a resonant frequency and variable capacitors connected in parallel to the transmission line.
Figure 17B:
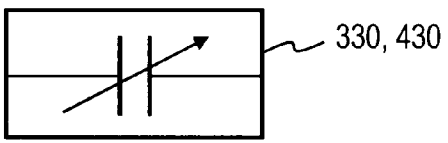
FIG. 17B is a diagram showing an example of the impedance transforming part capable of changing the characteristics that is formed by a variable capacitor.
Figure 17C:
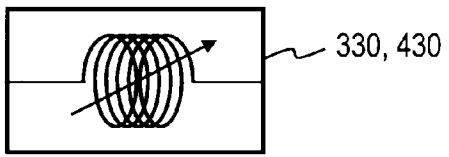
FIG. 17C is a diagram showing an example of the impedance transforming part capable of changing the characteristics that is formed by a variable coil.
Figure 17D:
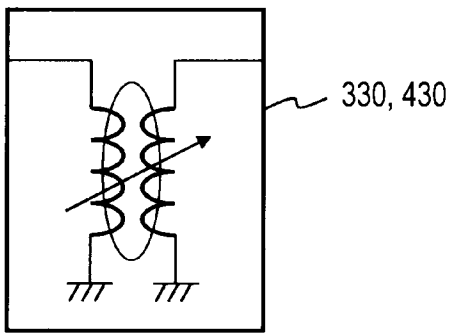
FIG. 17D is a diagram showing an example of the impedance transforming part capable of changing the characteristics that is formed by lines variably electromagnetically coupled to each other.
Figure 17E:
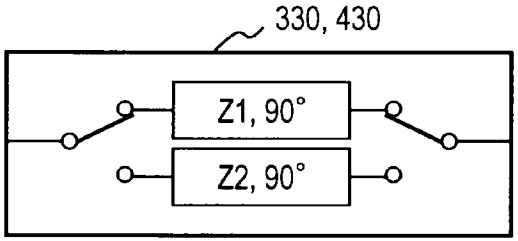
FIG. 17E is a diagram showing an example of the impedance transforming part capable of changing the characteristics that is formed by two kinds of transmission lines that have a length equal to a quarter wavelength at a resonant frequency and different characteristic impedances and are switched from one to another.
Figure 17F:
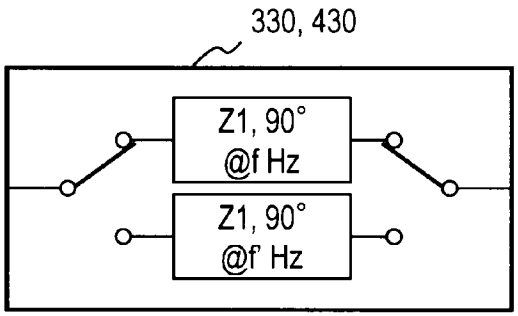
FIG. 17F is a diagram showing an example of the impedance transforming part capable of changing the characteristics that is formed by two kinds of transmission lines that have a length equal to a quarter wavelength at different resonant frequencies and the same characteristic impedance and are switched from one to another.

As shown in FIGS. 16A to 16E, the impedance transforming part used in the signal selecting devices according to the present invention can be:

a transmission line having a characteristic impedance of Z and a length equal to a quarter wavelength at the resonant frequency (FIG. 16A);

a capacitor (FIG. 16B);

a coil (FIG. 16C);

lines coupled by electromagnetic induction (FIG. 16D); or combinations thereof (FIG. 16E). As shown in FIGS. 17A to 17F, the variable impedance transforming circuit can be:

a transmission line having a characteristic impedance of Z and a length equal to a quarter wavelength at the resonant frequency to which variable capacitors are connected in parallel with each other (FIG. 17A);

a variable capacitor (FIG. 17B);

a variable coil (FIG. 17C);

lines variably electromagnetically coupled to each other (FIG. 17D);

two kinds of transmission lines that have a length equal to a quarter wavelength at the resonant frequency and different characteristic impedances and are switched from one to another (FIG. 17E); or two kinds of transmission lines that have a length equal to a quarter wavelength at different resonant frequencies and the same characteristic impedance and are switched from one to another (FIG. 17F). However, the present invention is not limited to the circuit examples listed above. Furthermore, the resonating part used in the signal selecting device according to the present invention has been described as a circular-ring-shaped line, the resonating part is not limited to the circular-ring-shaped line but can have any ring shape other than a circular ring.

Figure 18A:
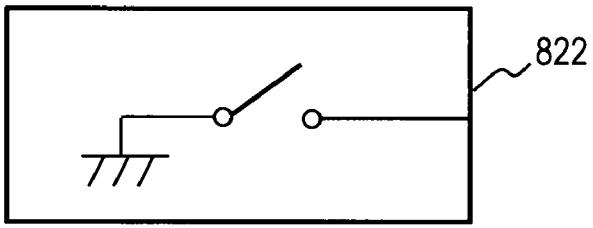
FIG. 18A is an example in which a switch that makes a short circuit is used as a switch when ring conductors are connected in series to a signal line.
Figure 18B:
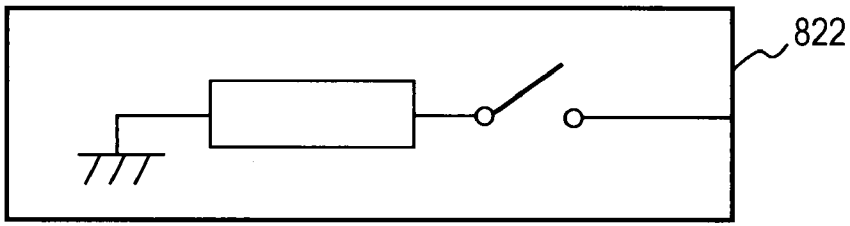
FIG. 18B is an example in which a switch that makes a short circuit via a transmission line is used as a switch when ring conductors are connected in series to a signal line.
Figure 18C:
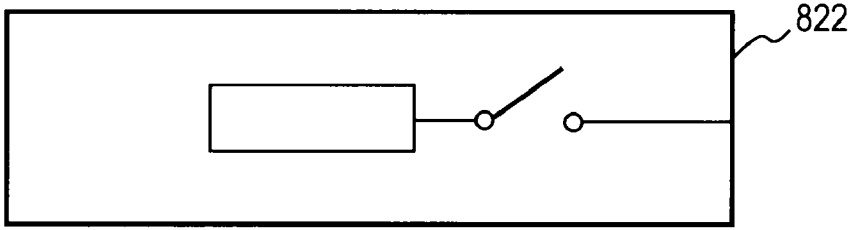
FIG. 18C is an example in which a switch that establishes a connection of a transmission line having an open end is used as a switch when ring conductors are connected in series to a signal line.

FIGS. 18A to 18C show exemplary configurations of the switch connected to the ring conductor. For example, the switch can be:

a switch that makes a short circuit (FIG. 18A);

a switch that makes a short circuit via a transmission line (FIG. 18B); or a switch establishes a connection of a transmission line having an open end (FIG. 18C). Different types of switches can be used, or switches having transmission lines of different lengths can be used. Alternatively, a switch having a transmission line whose length can be changed can be used. Furthermore, a switch that establishes a connection to a capacitor or a coil can also be used.

Figures 19A, 19B, 19C:
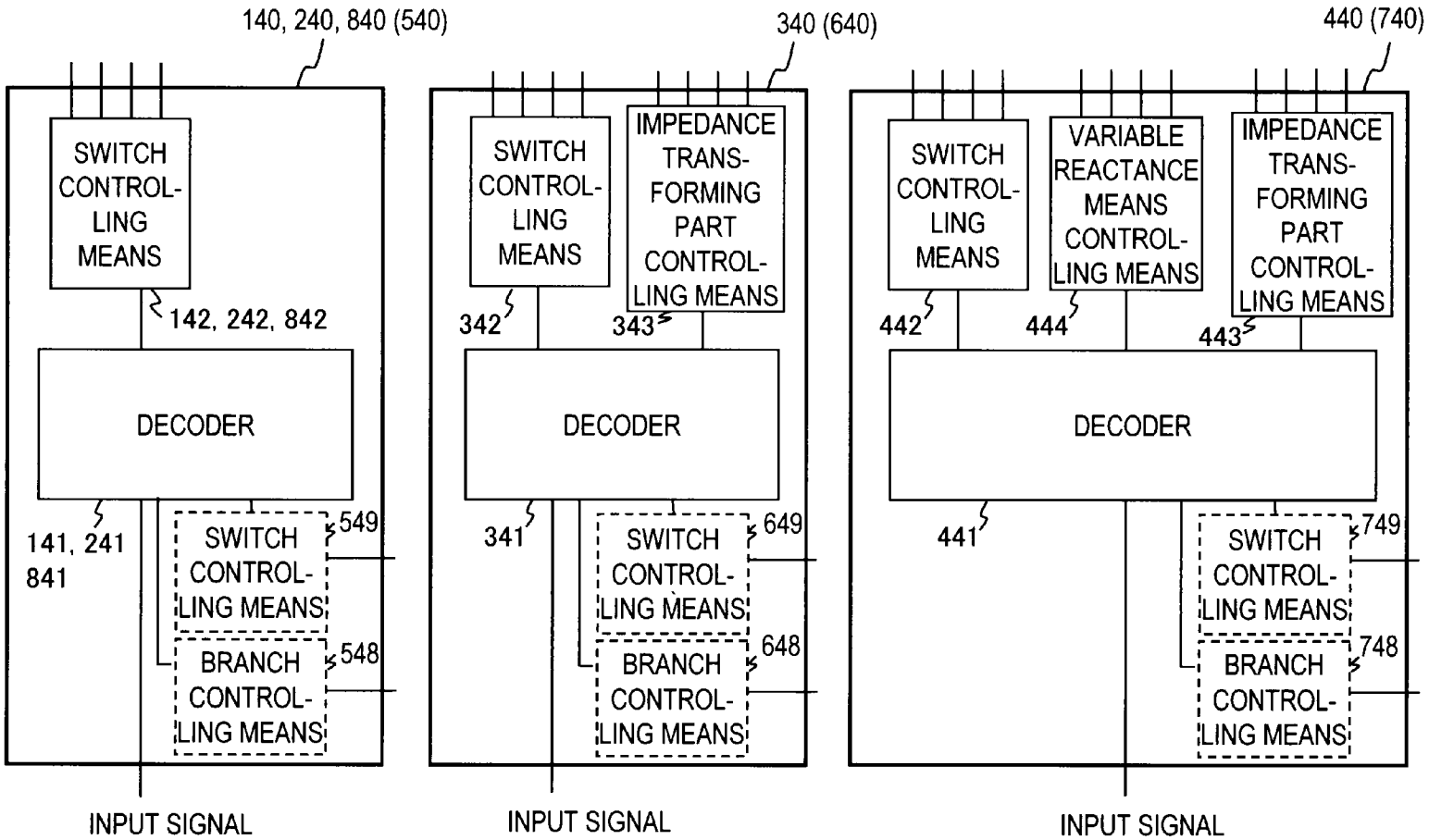
FIG. 19A is a diagram showing an exemplary functional configuration of a controlling part according to the embodiments 1, 2 and 8.
FIG. 19B is a diagram showing an exemplary functional configuration of a controlling part according to the embodiment 3.
FIG. 19C is a diagram showing an exemplary functional configuration of a controlling part according to the embodiment 4.

FIGS. 19A to 19C show exemplary functional configurations of the controlling part. FIG. 19A shows an exemplary functional configuration of the controlling parts 140, 240 and 840 according to the embodiments 1, 2 and 8, respectively. A decoder 141, 241, 841 serves to perform switching among a plurality of preset states. When a signal indicating a state is input to the decoder 141, 241, 841, the decoder instructs switch controlling means 142, 242, 842 to select and turn on a switch corresponding to the state. The switch controlling means 142, 242, 842 controls the state of the switches of the resonating parts $\mathbf{120}_1$ to $\mathbf{120}_N$, $\mathbf{220}_1$ to $\mathbf{220}_3$, $\mathbf{820}_1$ to $\mathbf{820}_N$ according to the instruction. FIG. 19B shows an exemplary functional configuration of the controlling part 340 according to the embodiment 3. A decoder 341 controls the characteristics of the impedance transforming parts in addition to serving the same function as the decoder 141, 241, 841. The decoder 341 issues an instruction to impedance transforming part controlling means 343 according to an input signal. The impedance transforming part controlling means 343 changes the characteristics of the impedance transforming parts $\mathbf{330}_{0,1}$ to $\mathbf{330}_{N,N+1}$ according to the instruction. FIG. 19C shows an exemplary functional configuration of the controlling part 440 according to the embodiment 4. A decoder 441 controls the characteristics of the variable reactance means in addition to serving the same function as the decoder 341. The decoder 441 issues an instruction to variable reactance means controlling means 444 according to an input signal. The variable reactance means controlling means 444 changes the characteristics of the reactance variable means according to the instruction. The dotted lines in FIGS. 19A to 19C represent branch part controlling means 548, 648, 748 and switch part controlling means 549, 649, 749, which are added to the controlling part in the case where the signal selecting device has the branch parts and the switch part as shown in the embodiments 5 to 7. In this case, the controlling part also controls the branch parts and the switch part. Therefore, the decoder 141, 241, 341, 441, 841 also issues an instruction to the branch part controlling means 548, 648, 748 and the switch part controlling means 549, 649, 749 according to the input signal. The branch part controlling means 548, 648, 748 and the switch part controlling means 549, 649, 749 change the state of connection between the branch parts and the switch part according to the instruction.

Figures 20A, 20B, 20C:
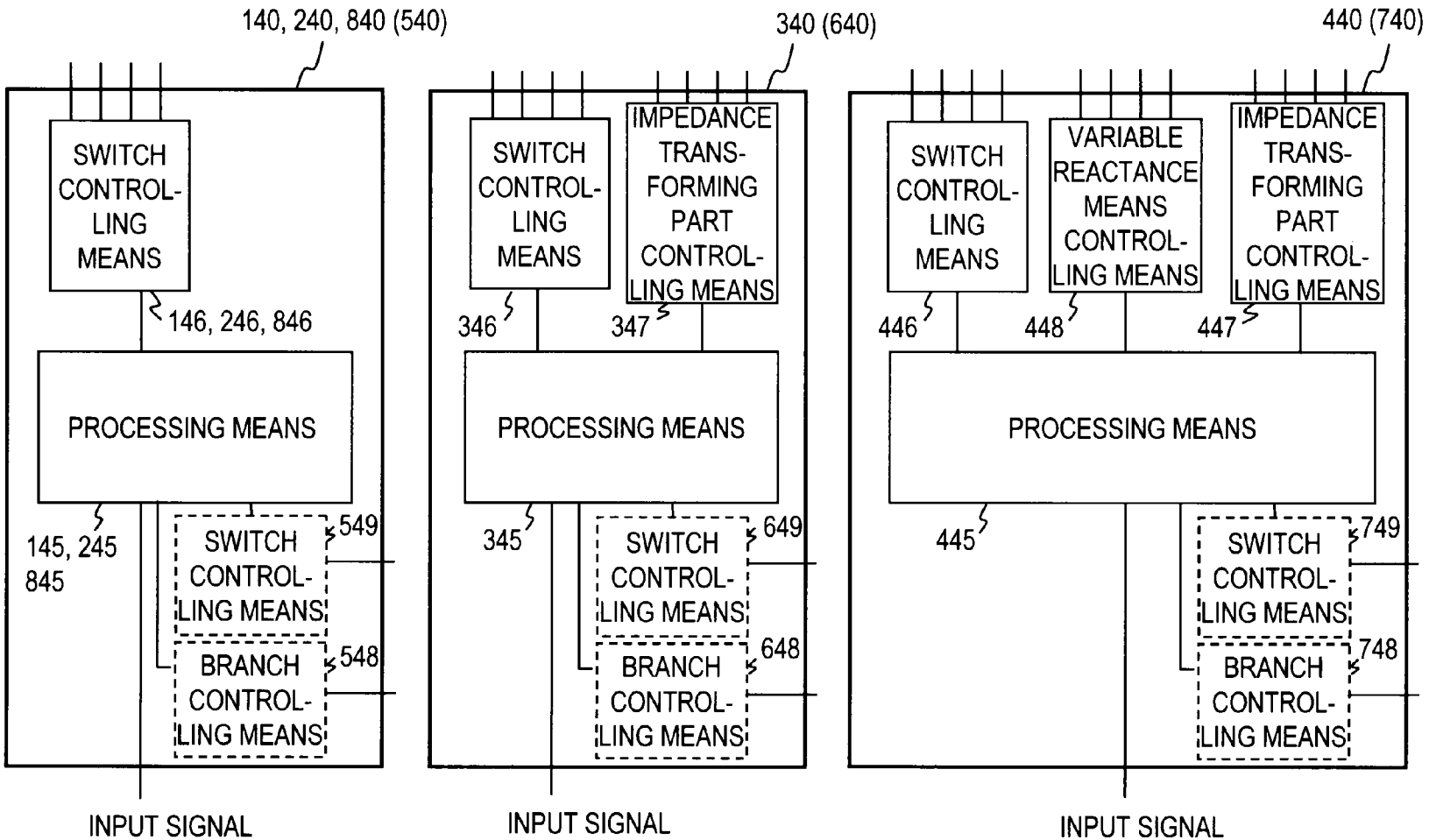
FIG. 20A is a diagram showing another exemplary functional configuration of the controlling part according to the embodiments 1 and 2.
FIG. 20B is a diagram showing another exemplary functional configuration of the controlling part according to the embodiment 3.
FIG. 20C is a diagram showing another exemplary functional configuration of the controlling part according to the embodiment 4.

FIGS. 20A to 20C show other exemplary functional configurations of the controlling part. FIG. 20A shows an exemplary functional configuration of the controlling parts 140 and 240 according to the embodiments 1 and 2, respectively. Processing means 145, 245 receives the bandwidth w and the in-band and out-band characteristics (whether the characteristics is Butterworth characteristics or not, whether the characteristics is Chebyshev characteristics or not, what decibel the ripple is in the case of Chebyshev characteristics, or the like) as an input signal. The processing means 145, 245 determines which switch is to be turned on based on the input signal and issues an instruction to switch controlling means 146, 246. The switch controlling means 146, 246 controls the state of the switches of the resonating parts $\mathbf{120}_1$ to $\mathbf{120}_N$, $\mathbf{220}_1$ to $\mathbf{220}_3$ according to the instruction. FIG. 20B shows an exemplary functional configuration of the controlling part 340 according to the embodiment 3. Processing means 345 controls the characteristics of the impedance transforming parts in addition to serving the same function as the processing means 145, 245. The processing means 345 determines the way of changing the characteristics of the impedance transforming parts based on the input signal and issues an instruction to impedance transforming part controlling means 347. The impedance transforming part controlling means 347 changes the characteristics of the impedance transforming parts $\mathbf{330}_{0,1}$ to $\mathbf{330}_{N,N+1}$ according to the instruction. FIG. 20C shows an exemplary functional configuration of the controlling part 440 according to the embodiment 4. Processing means 445 controls the characteristics of the variable reactance means in addition to serving the same function as the processing means 345. An input signal to the processing means 445 includes information about the center frequency. The processing means 445 determines the way of changing the characteristics of the variable reactance means based on the input signal and issues an instruction to variable reactance means controlling means 448. The variable reactance means controlling means 448 changes the characteristics of the reactance variable means according to the instruction. The dotted lines in FIGS. 20A to 20C represent the branch part controlling means 548, 648, 748 and the switch part controlling means 549, 649, 749, which are added to the controlling part in the case where the signal selecting device has the branch parts and the switch part as shown in the embodiments 5 to 7. The processing means 145, 245, 345, 445, 845 also issues an instruction to the branch part controlling means 548, 648, 748 and the switch part controlling means 549, 649, 749 according to the input signal. The branch part controlling means 548, 648, 748 and the switch part controlling means 549, 649, 749 change the state of connection between the branch parts and the switch part according to the instruction.

Figure 21B:
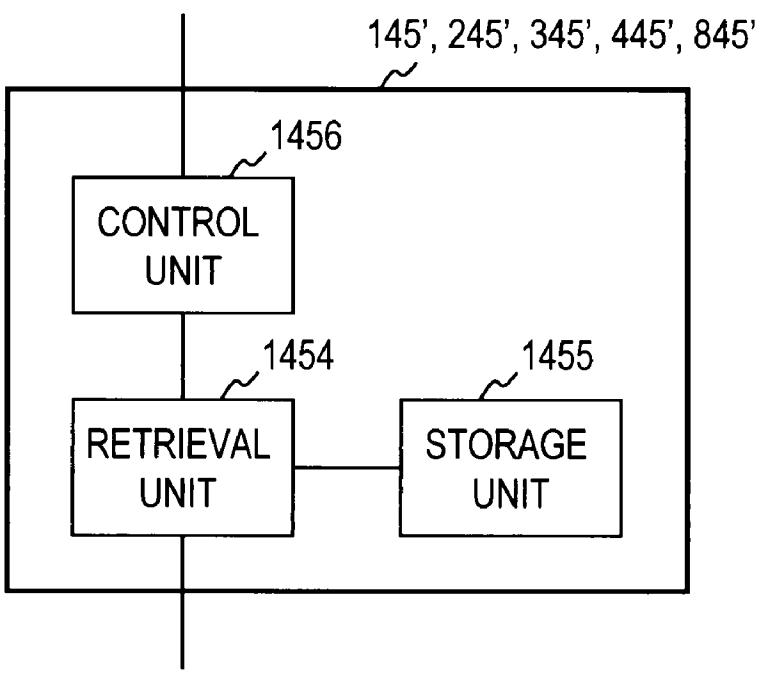
FIG. 21B is an example of the processing means that is composed of a retrieval unit, a storage unit and a control unit.
Figure 21A:
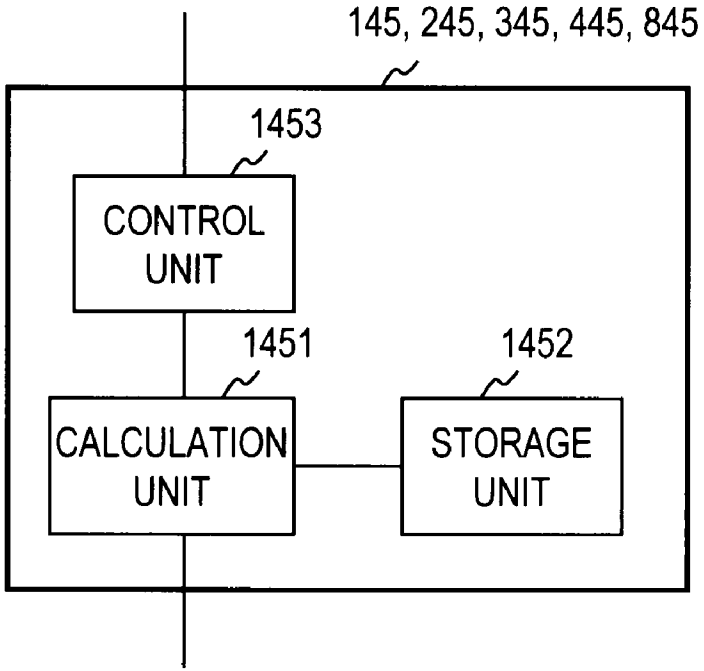
FIG. 21A is an example of processing means that is composed of a calculation unit, a storage unit and a control unit.

FIGS. 21A and 21B show exemplary functional configurations of the processing means. FIG. 21A shows an example of the processing means composed of a calculation unit, a storage unit and a control unit. A calculation unit 1451 determines the susceptance slope parameter according to the formulas (4) to (6) using information, such as the bandwidth and the in-band and out-band characteristics. Then, the calculation unit 1451 determines θ from the susceptance slope parameter. Furthermore, the calculation unit 1451 selects a switch closest to the determined θ based on switch position information or the like stored in a storage unit 1452 and instructs a control unit 1453 to turn on the selected switch. According to the instruction, the control unit 1453 controls the switch controlling means, the impedance transforming part controlling means, the variable reactance means controlling means, the branch part controlling means and the switch part controlling means. FIG. 21B shows an example of the processing means composed of a retrieval unit, a storage unit and a control unit. In this case, a storage unit 1455 stores a lookup table, for example. A retrieval unit 1454 retrieves a condition closest to the condition indicated by an input signal from the lookup table and obtains information about the current state of the switch, the impedance transforming part, the variable reactance means, the branch part controlling means and the switch part controlling means. Then, the retrieval unit 1454 issues an instruction to a control unit 1456. Alternatively, the examples shown in FIGS. 21A and 21B can be combined to each other. For example, if the condition indicated by the input signal is found in the lookup table, the condition can be used, and if the condition indicated by the input signal is not found in the lookup table, calculation can be performed.

As the impedance transforming part controlling means that controls the impedance transforming parts capable of changing the characteristics, circuits described below can be used. In the case where the impedance transforming parts change the characteristic impedance in a discrete manner (a case where a plurality of switches are used to control the characteristics, for example), a digital variable impedance transforming circuit controlling circuit can be used as the impedance transforming part controlling means. In the case where the impedance transforming part change the characteristic impedance in a continuous manner (a case where a varactor using a diode is used, for example), a variable impedance transforming circuit controlling circuit, such as a D/A converter, can be used as the impedance transforming part controlling means. The same holds true for the variable reactance means controlling means.

What is claimed is:

1. A signal selecting device, comprising:

two input/output ports;

N resonating parts having a ring conductor having a length equal to one wavelength at a resonant frequency or an integral multiple thereof and a plurality of switches each of which is connected to a different part of said ring conductor at one end and to a ground conductor at the other end;

N+1 impedance transforming parts that adjusts impedance; and a controlling part that controls the state of said plurality of switches, wherein N is an integer equal to or larger than two, said N+1 impedance transforming parts said N resonating parts are disposed in series alternately between said two input/output ports, and said different part of each of said ring conductors is not a point where each of said ring conductors couples with a conductor transmitting a signal inputted into one of said input/output ports.

2. The signal selecting device according to claim 1, wherein at least one of said N+1 impedance transforming parts is capable of changing characteristics, and said controlling part is capable of controlling the characteristics.

3. The signal selecting device according to claim 1, wherein said signal selecting device has an odd number of said resonating parts, said N+1 impedance transforming parts have characteristics that are the same.

4. The signal selecting device according to claim 3, wherein all of said N+1 impedance transforming parts are capable of changing said characteristics, and said controlling part is capable of controlling the characteristics while maintaining said same characteristics.

5. The signal selecting device according to claim 1, wherein said signal selecting device has an even number of said resonating parts, at least one of said N+1 impedance transforming parts is capable of changing characteristics, and said controlling part is capable of controlling the characteristics.

6. The signal selecting device according to claim 5, wherein the impedance transforming part disposed at the center of said N+1 impedance transforming parts is capable of changing said characteristics.

7. A controlling method for a signal selecting device which has two input/output ports;

N resonating parts having a ring conductor having a length equal to one wavelength at a resonant frequency or an integral multiple thereof and a plurality of switches each of which is connected to a different part of said ring conductor at one end and to a ground conductor at the other end;

N+1 impedance transforming parts that adjusts impedance; and a controlling part that controls the state of said plurality of switches, wherein N is an integer equal to or larger than two, and said N+1 impedance transforming parts and said resonating parts are disposed in series alternately between said two input/output ports, comprising the steps of:

(a) determining fractional bandwidth (w) and element values ($g_0$ to $g_{N+1}$) of a low-pass prototype filter from bandwidth and in-band and out-band characteristics of the signal selecting device to be achieved, (b) calculating admittance parameters ($J_{0,1}$ to $J_{N,N+1}$) from characteristics of the circuit of the impedance transforming part, and (c) selecting said switches to be turned on among the plurality of switches so that susceptance slope parameters ($b_1$ to $b_N$) satisfy $$J_{0,1} = \sqrt{\frac{Gb_1 w}{g_0 g_1}},$$

$$J_{k-1,k} = w\sqrt{\frac{b_{k-1} b_k}{g_{k-1} g_k}}, \text{ and}$$

$$J_{N,N+1} = \sqrt{\frac{Gb_N w}{g_N g_{N+1}}}$$

where n is an integer from 1 to N, M is number of said switches, G denotes port admittance, and k is an integer from 2 to N.

8. The signal selecting device according to claim 1, further comprising:

one or more branch parts that have three terminals and switches the state of connection between a predetermined terminal and the remaining terminals of the three terminals; and a switch part that has three or more terminals and switches the state of connection between a predetermined terminal and the remaining terminals of the three or more terminals, wherein said switch part is disposed between one of said input/output ports and said N+1 impedance transforming parts in a state where the predetermined terminal of the switch part is connected to said one of input/output ports, said branch parts are disposed between said N+1 impedance transforming parts and said resonating parts in a state where the predetermined terminal of the branch part is connected to the side of the other input/output port, one of the remaining three terminals of said branch parts is connected to one of the remaining three or more terminals of said switch part, and said controlling part is capable of controlling the state of connection between said branch parts and said switch part.

9. The signal selecting device according to claim 1, wherein n is an integer from 1 to N, M is a number of said switches, a fractional bandwidth (w) and element values ($g_0$ to $g_{N+1}$) of a low-pass prototype filter are determined from bandwidth and in-band and out-band characteristics of the signal selecting device to be achieved, admittance parameters ($J_{0,1}$ to $J_{N,N+1}$) are calculated from characteristics of the circuit of the impedance transforming part, and said switches to be turned on are selected among the plurality of switches so that susceptance slope parameters ($b_1$ to $b_N$) satisfy $$J_{0,1} = \sqrt{\frac{Gb_1 w}{g_0 g_1}},$$

$$J_{k-1,k} = w\sqrt{\frac{b_{k-1} b_k}{g_{k-1} g_k}}, \text{ and}$$

$$J_{N,N+1} = \sqrt{\frac{Gb_N w}{g_N g_{N+1}}}$$

where G denotes port admittance, and k is an integer from 2 to N.

10. The signal selecting device according to claim 2, further comprising:

one or more branch parts that have three terminals and switches the state of connection between a predetermined terminal and the remaining terminals of the three terminals; and a switch part that has three or more terminals and switches the state of connection between a predetermined terminal and the remaining terminals of the three or more terminals, wherein said switch part is disposed between one of said input/output ports and said N+1 impedance transforming parts in a state where the predetermined terminal of the switch part is connected to said input/output port, said branch parts are disposed between said N+1 impedance transforming parts and said resonating parts in a state where the predetermined terminal of the branch part is connected to the side of the other input/output port, one of the remaining three terminals of said branch parts is connected to one of the remaining three or more terminals of said switch part, and said controlling part is capable of controlling the state of connection between said branch parts and said switch part.

11. The signal selecting device according to any one of claims 2, 4, 5, 6, and 10 wherein said resonating parts have three or more variable reactance means connected to said ring conductor, and said controlling part is capable of controlling the state of said variable reactance means.

* * * * *